US005863148A

United States Patent [19]

Shivaram

[11] Patent Number: 5,863,148

[45] Date of Patent: Jan. 26, 1999

[54] PREFABRICATED HIGHWAY WITH END SUPPORTS

[76] Inventor: Mukundan Shivaram, 804 Piedmont Cir., Naperville, Ill. 60565-3407

[21] Appl. No.: 698,919

[22] Filed: Aug. 27, 1996

[51] Int. Cl.[6] ..... E01C 3/00

[52] U.S. Cl. ..... 404/28; 404/71; 14/73; 14/75; 14/73.5

[58] Field of Search ..... 14/2.4, 6, 78, 73, 14/74.5, 77.1, 75, 77.3; 404/1, 2, 17, 27, 28, 50, 51, 71, 73, 82; 52/174, 223.6, 223.7, 223.11, 602; 238/10 A, 10 B, 10 R, 119; 472/85

[56] References Cited

U.S. PATENT DOCUMENTS

| | | | |
|---|---|---|---|
| 105,195 | 7/1870 | Gregory | 14/75 |
| 1,335,180 | 3/1920 | Morrison . | |
| 2,138,340 | 11/1938 | Chemidlin | 238/10 X |
| 2,184,137 | 12/1939 | Brewer | 14/73 |
| 3,125,009 | 3/1964 | Eberl | 94/4 |
| 3,213,768 | 10/1965 | Jensen | 94/14 |
| 3,272,096 | 9/1966 | Lum | 404/1 |
| 3,706,125 | 12/1972 | Hopkins | 14/75 X |
| 3,712,187 | 1/1973 | Stelling | 94/4 |
| 3,810,708 | 5/1974 | Olsson | 404/72 |
| 3,892,096 | 7/1975 | Macchi | 52/223.11 |
| 4,145,153 | 3/1979 | Fasullo et al. | 404/73 |
| 4,181,995 | 1/1980 | Zur | 404/1 X |
| 4,531,857 | 7/1985 | Bettigole | 404/44 |
| 4,826,076 | 5/1989 | Hesse | 238/10 A X |
| 4,865,486 | 9/1989 | Bettigole | 404/75 |
| 4,918,777 | 4/1990 | Ashley | 14/73 |
| 5,082,393 | 1/1992 | Ringesten et al. | 404/28 |
| 5,123,777 | 6/1992 | Tadros | 404/34 |
| 5,265,481 | 11/1993 | Sonderegger et al. | 73/862.625 |
| 5,285,610 | 2/1994 | Schaaf et al. | 52/223.7 X |
| 5,406,663 | 4/1995 | Chen | 14/75 |
| 5,483,716 | 1/1996 | Burnaman | 14/73 |
| 5,491,475 | 2/1996 | Rouse et al. | 340/933 |
| 5,520,056 | 5/1996 | Buisoon et al. | 73/784 |

FOREIGN PATENT DOCUMENTS

| | | | |
|---|---|---|---|
| 1024007 | 3/1966 | United Kingdom | 404/1 |

*Primary Examiner*—James Lisehora
*Attorney, Agent, or Firm*—Welsh & Katz, Ltd.

[57] ABSTRACT

A prefabricated highway with end supports. The end supports include a first elongated support member for transverse engagement of a longitudinal end of the prefabricated highway section and a second elongated support member parallel to the first support member and aligned with the first member along an orthogonal axis for abutting an earth support of the prefabricated highway. The end supports further include a connecting member joining the first and second elongated members in a rigid spaced-apart relationship.

The support structure is used as part of a prefabricated highway system. The prefabricated highway system uses the support structures for support of individual lane sections. The prefabricated lane sections are fabricated out of prestressed concrete and are designed to be supported longitudinally in a direction of traffic flow at each end by an upper surface of the first elongated support member of each support section. Lateral movement of the lane sections are prevented by a rib disposed in a bottom of each lane section and a complementary notch in top of each support structure. Lateral movement of each support structure is prevented by bolting together opposing ends of the first and second elongated support members of adjacent support structures of adjacent traffic lanes.

The prefabricated lane sections are delivered to a construction site with lane markers and lane dividers already installed. Sensors are preinstalled in each lane section for purposes of monitoring traffic activity and the structural integrity of the lane section and supporting support structures. Wear sensors and weather condition sensors are also provided within the lane sections. Conduit is provided within each lane section to route sensor wiring to a local department of transportation office.

22 Claims, 33 Drawing Sheets

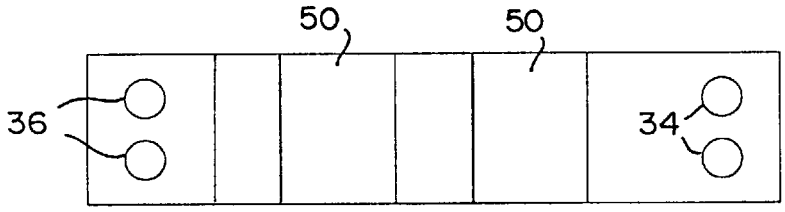
FIG. 3B
FIG. 3E
FIG. 3D
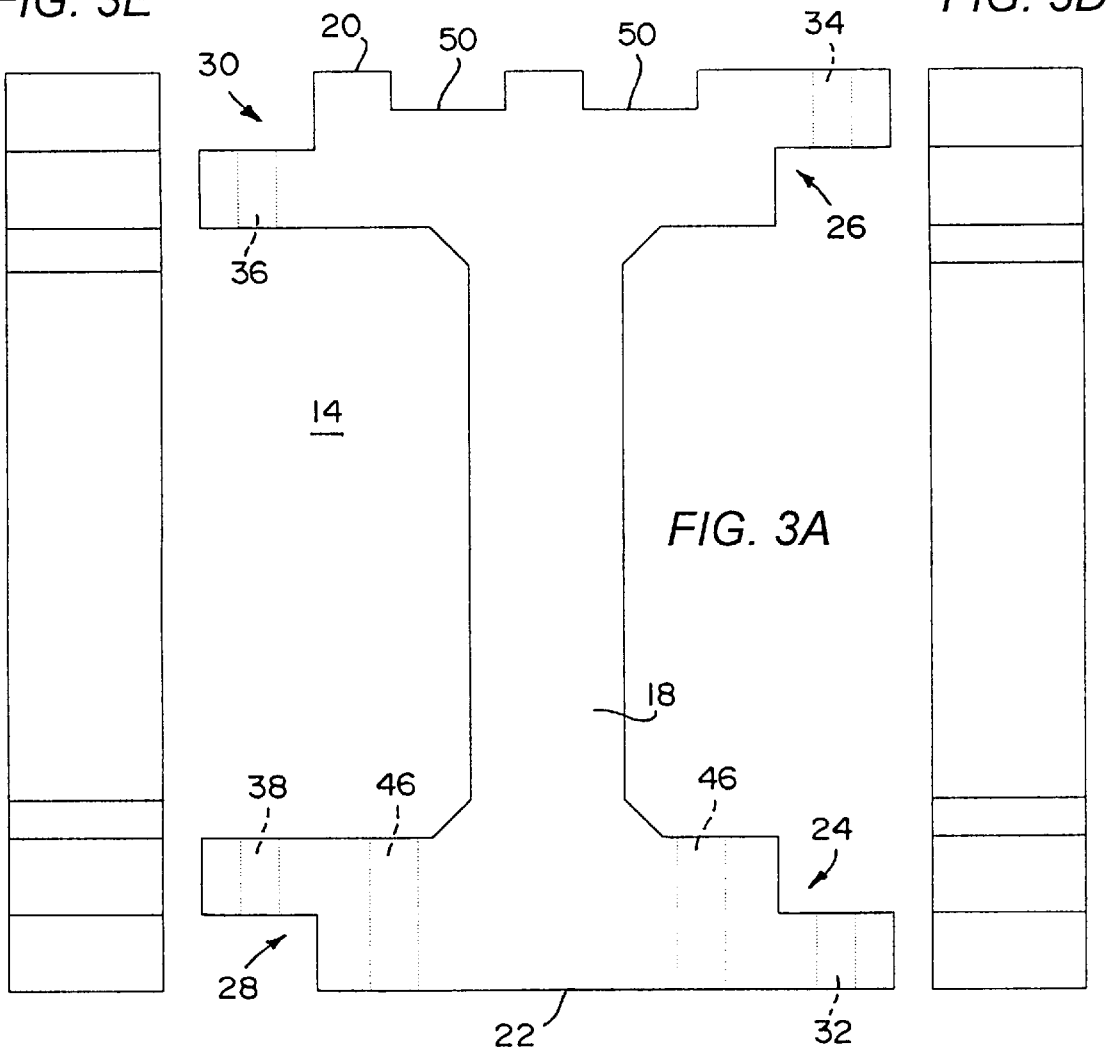
FIG. 3A
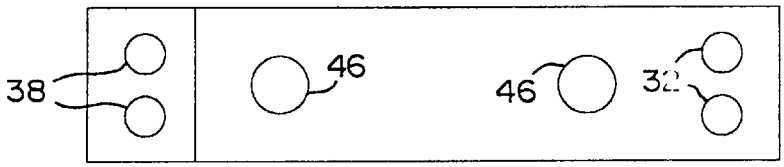
FIG. 3C

FIG. 11B
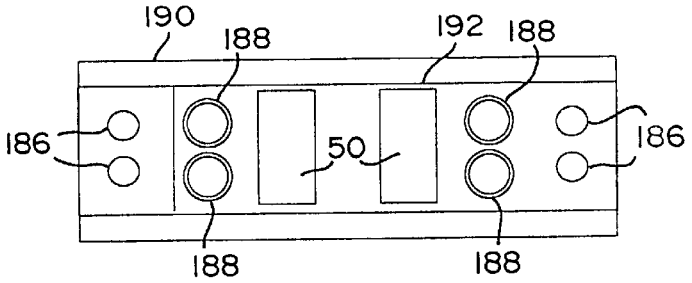
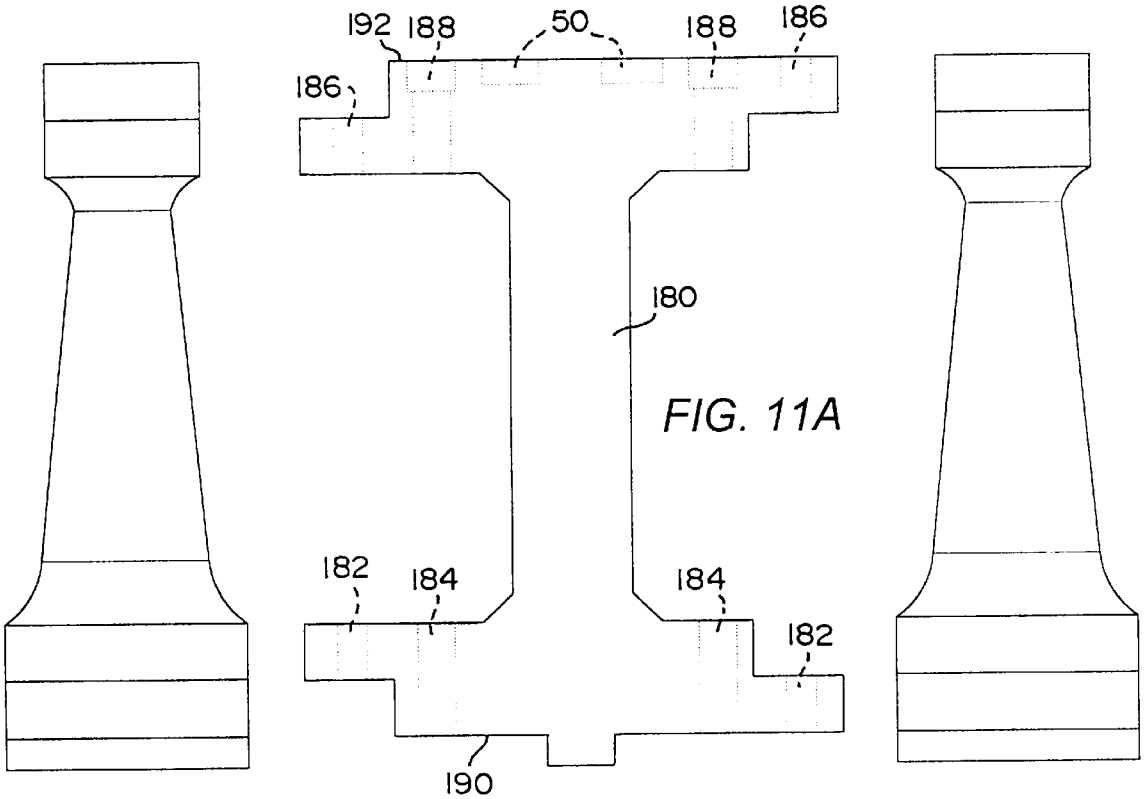
FIG. 11A
FIG. 11E
FIG. 11D
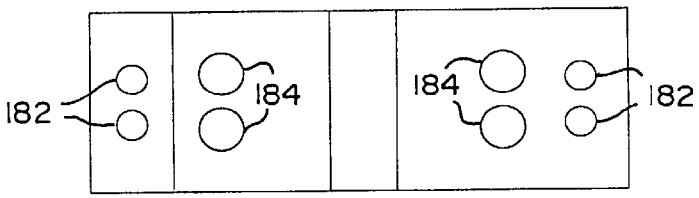
FIG. 11C

PREFABRICATED HIGHWAY WITH END SUPPORTS

FIELD OF THE INVENTION

The field of the invention relates to prefabricated highways and, more particularly, to prefabricated highways with end supports.

BACKGROUND OF THE INVENTION

Highways and highway construction techniques are generally known and are based on well-known practices. The state-of-the-art in road building technology, in fact, has not changed much over the centuries. Indeed, roads have not changed in any significant degree since old foot paths gradually expanded to support horse-and-buggy traffic, then motor cars and then became today's super-highways.

In contrast, the surfaces of roadways have improved somewhat. Roads now support much larger vehicles, at greater speeds, and in greater numbers.

To a significant degree, advances in roadway construction technology have come with the development of large earth moving machines, capable of excavating and moving several cubic yards of dirt and rocks in a single step, digging trenches to depths previously unthinkable, while other machines could fill and compact successive layers of aggregate into those trenches.

Sophisticated "mobile factories" can put down thin layers of asphalt consistently, mile after mile, over compacted aggregates. Alternatively, mobile cement mixers coupled to spreading and leveling equipment have been used to lay down relatively thick road surfaces of reinforced concrete. Often asphalt is added as a cushioning layer over the reinforced concrete.

Basic road building techniques and designs have not changed. Machines just do the work with greater efficiency and speed.

The whole process starts over in a few months as wear and tear, faulty (and sometimes shoddy) construction techniques, poor materials and weather extremes affect the integrity and driveability of the highway system. The US Interstate Highway system, built at costs approaching (and exceeding) $1 million per mile, is in a state of disrepair. Annual rebuilding of Interstate Highways is commonplace. The infrastructure is crumbling in every state of the union. Existing road surfaces have proven incapable of providing the load carrying capacities and speeds required by interstate commerce today. Cost estimates to rebuild America's infrastructure (e.g., highways and bridges, etc.) range from a hundred billion to as high as a trillion dollars. The annual cost of infrastructure maintenance, just in the United States, is in the billions.

In frostbelt countries, temperature differences between winter and summer affects the life of road surfaces. Frost heaves, and the use of snow plows and snow chains, cause damage to road surfaces. Pot holes and cracks in the roadway result from repeated melting and freezing of the roadway. Heavy truck traffic shortens the expected life span of roadways. Trucks exceeding weight and speed limits further exacerbate the problem.

In equatorial counties, extremes of heat and rain reduce life expectancy of road surfaces. High temperatures buckle roadways and damage asphalt. Traffic on heat softened asphalt results in permanent ruts. Water logged roadways often suffer surface damage, erosion, and catastrophic settling.

Insufficient funding, poor construction techniques, inadequate quality controls and inspections, inappropriate equipment and materials, compound rapid road surface deterioration problems in the U.S. and many other countries.

What is needed is a construction method that can accommodate today's high speeds and heavy traffic and is applicable to all climates and all countries. The highway produced by such methods should be easy to build and should adhere to measurable and enforceable construction standards, using materials that are readily available. It must advance the state-of-the-art in roadbuilding technology. It should be easy to build and re-build. It should be easy to maintain.

SUMMARY

A prefabricated highway with end supports. The end supports include a first elongated support member for transverse engagement of a longitudinal end of the prefabricated highway section and a second elongated support member parallel to the first support member and laterally aligned with the first member along an orthogonal axis for abutting an earth support of the prefabricated highway. The end supports further include a connecting member joining the first and second elongated members in a rigid spaced-apart relationship.

The support structure is used as part of a prefabricated highway system. The prefabricated highway system uses the support structures for support of individual lane sections. The prefabricated lane sections are fabricated out of prestressed concrete and are designed to be supported longitudinally in a direction of traffic flow at each end by an upper surface of the first elongated support member of each support section. Lateral movement of the lane sections are prevented by a rib disposed in a bottom of each lane section and a complementary notch in top of each support structure. Lateral movement of each support structure is prevented by bolting together opposing ends of the first and second elongated support members of adjacent support structures of adjacent traffic lanes.

The prefabricated lane sections are delivered to a construction site with lane markers and lane dividers already installed. Sensors are preinstalled in each lane section for purposes of monitoring traffic activity and the structural integrity of the lane section and supporting support structures. Wear sensors and weather condition sensors are also provided within the lane sections. Conduit is provided within each lane section to route sensor wiring to a local department of transportation office.

BRIEF DESCRIPTION OF THE DRAWINGS

FIG. 3 is a top, bottom and side view of an anchor of FIG. 1;

FIG. 11 depicts another embodiment of the anchors of FIG. 1;

DETAILED DESCRIPTION OF A PREFERRED EMBODIMENT

Figure 1:
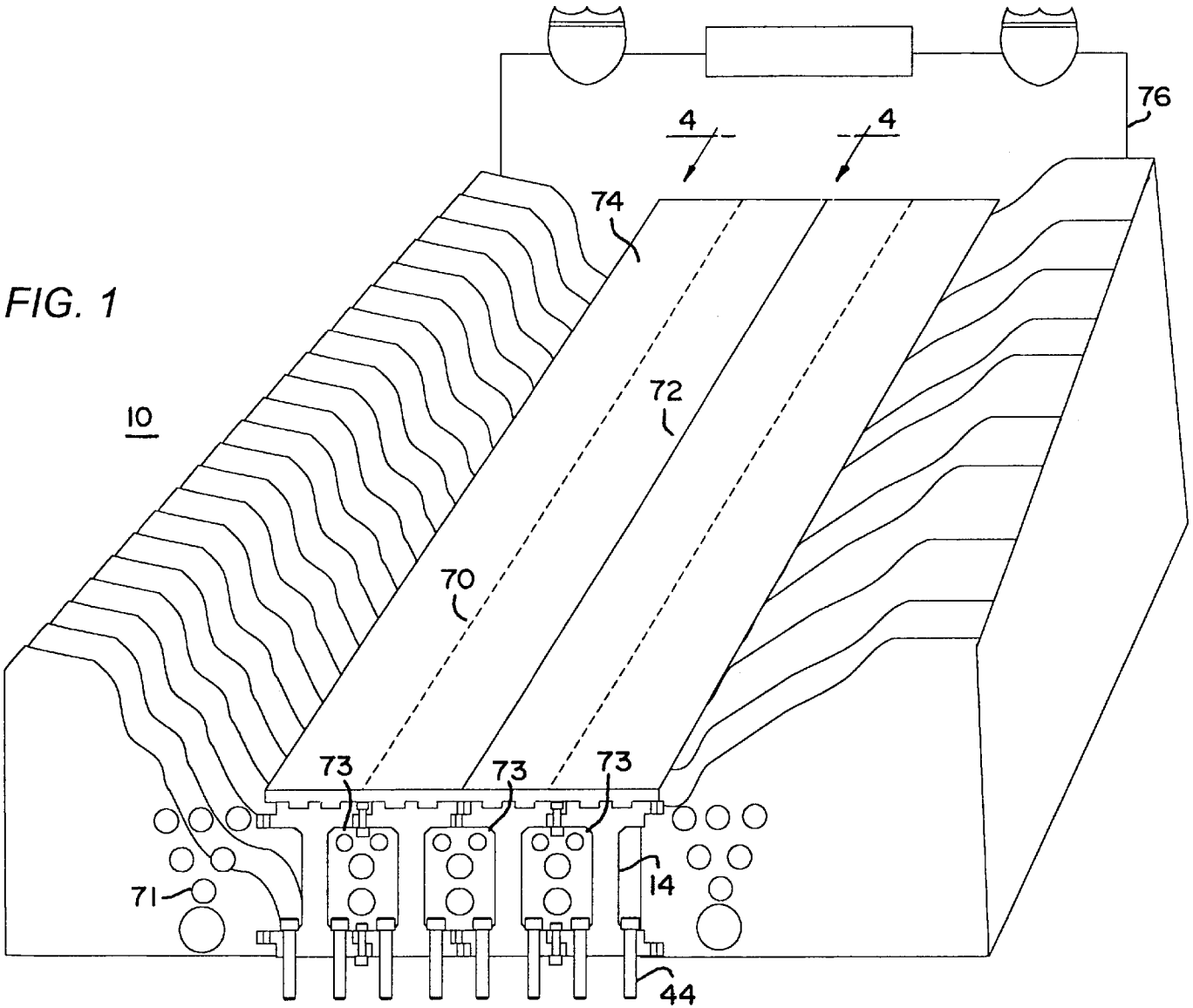
FIG. 1 is a perspective view of a prefabricated highway in accordance with an embodiment of the invention.
Figures 2A, 2B:
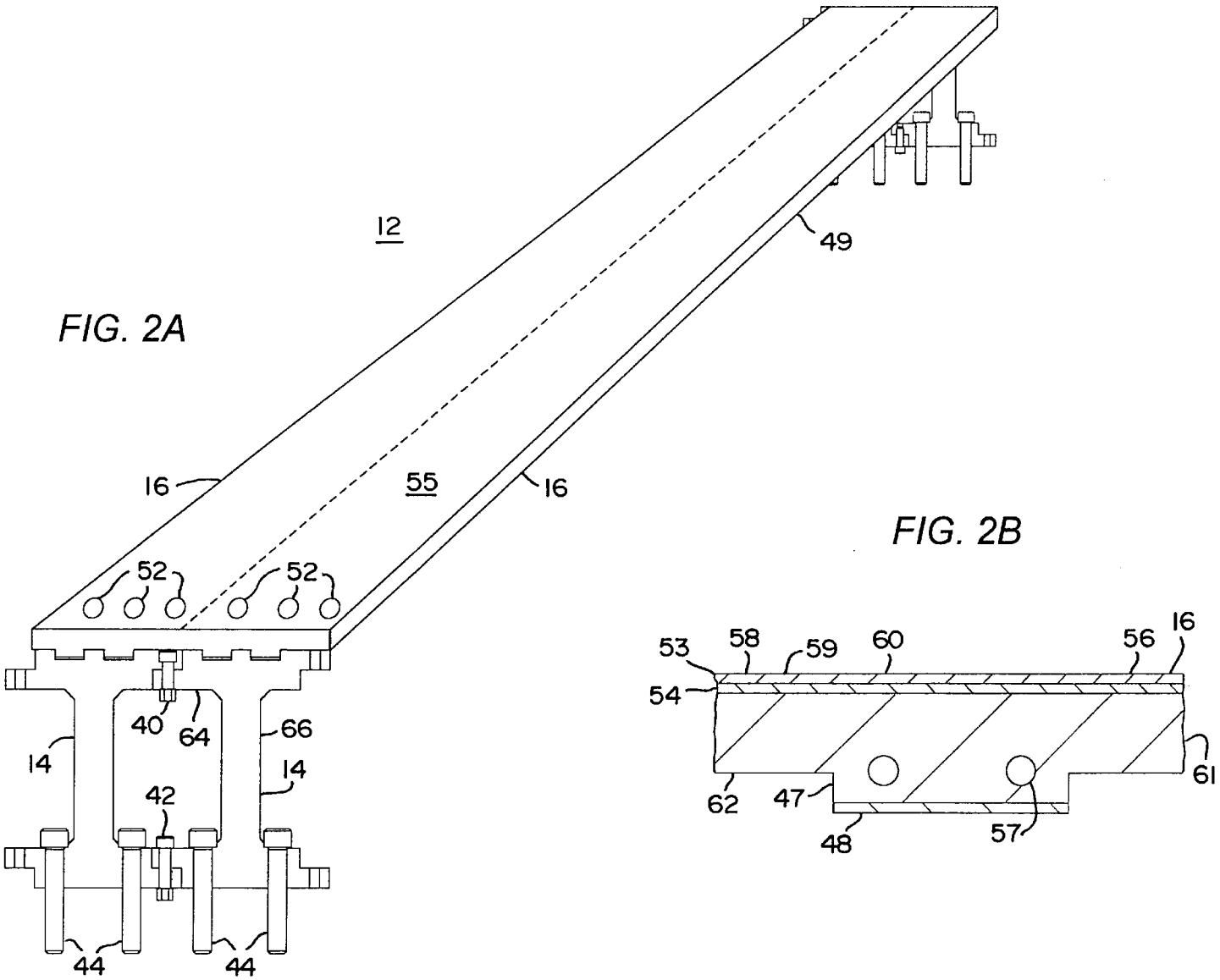
FIG. 2 is a perspective view of a lane section of the prefabricated highway of FIG. 1.

FIG. 1 is a cut-away perspective view of a prefabricated highway system 10, generally, in accordance with an embodiment of the invention. Each highway section 12 (FIG. 2) of the prefabricated highway 10 includes at least one lane section 16 (two adjacent lane sections 16 are shown in FIG. 2) supported by an anchor 14 on each end. Each lane section 16 and anchor may be prefabricated in a factory environment and trucked to the road construction site.

The prefabricated highway system 10 described herein addresses the fundamental problems of the prior art by combining the best features of bridge, rail, and road construction technologies with an innovative use of existing technologies. The highway system 10 is applicable to all climes, economies, equipment, capacities and speeds. The prefabricated highway system 10 achieves a level of standardization, versatility and simplification that heretofore has not been available.

The construction method used to create the prefabricated highway system 10 is a revolutionary technique for building road structures. The method may be used to create the prefabricated highway system 10 using prefabricated anchors and lane sections using a building block paradigm. With this new paradigm, most of the roadway may be factory built and assembled on site, unlike current road-building technologies.

Roadways 10 are assembled from prefabricated components, with each component engineered specifically for characteristics unique to that roadway. Applicable equally to interstate highways, city streets and rural roads, the prefabricated highway system 10 provides low-cost construction, minimal maintenance and fast replacement where necessary. The prefabricated highway system has several additional uses (e.g., specialized floors for warehouses, train station platforms, airport runways and taxiways, parking lots, etc.) all of which can be custom-built for their specific loading and climatic conditions. This list is by no means exhaustive. Features unique to the highway system 10, inter alia, include: 1) minimal surface preparation; 2) prefabricated lane sections and anchors, and/or built-to-spec lane sections, anchors, pylons, bolts, drainage systems, etc.; 3) integrated sensors for measuring roadway wear, stress levels, metal fatigue and vehicle speed; 4) integrated electrical harness, communications cabling, cable conduits and a multi-level drainage system; and 5) measurable, enforceable standards for materials and construction.

The use of the lane sections 16 and anchors 14 allows the section 12 to be self-supporting, modular and easily repaired, without resorting to reconstruction of the entire section 12. Instead of supporting the highway along its entire length through use of a compacted aggregate, the prefabricated highway section relies on end supports (anchors) 14 for the support of each lane section 16 of the prefabricated highway section 12.

Anchors 14 provide the base and support to "anchor" each lane section. Stabilizers (e.g., ribs 47 and mating notches 50 in lane sections 16 and anchors 14) are built into both the anchors and lane sections. Stabilizers prevent skewing, and side-to-side motion, giving the roadway additional strength, stability and firmness. Chemical joining of the anchors 14 and lane sections 16 provide noise and vibration isolation. Anchors 14 are held firmly in place using techniques similar to those used for high tension electrical transmission towers and bridges (e.g., Malone anchors, bell caissons, etc.).

Surface preparation in the past has been a significant factor in the cost of highway construction. Huge amounts of soil are moved, then replaced by successive layers of aggregates. Excavated materials are usually trucked out of the area and aggregate trucked into the construction zone to replace it. Each layer is compacted, then allowed to settle for some time. Even with all this preparation, settling still occurs, causing "unexpected damage". Any construction method which minimizes surface preparation significantly reduces building and maintenance costs.

With the prefabricated system 10 described herein, surface preparation is limited to building trenches for the anchors, to an engineered depth. Excavated soils, rocks and aggregates are reusable, replacing most of the aggregates necessary for prior art construction. Extensive reprocessing of excavated materials (e.g., grading for size, removal of debris, etc.) is not required.

Before the final road surface of the highway system 10 is put into place, a light compacting of the fill between anchors 14 is required, primarily to fill any voids. There is no need to wait for settling, as in prior constructions methods, because the fill is neither subjected to loading, nor exposed to the ravages of the weather. Anchors 14 now support the roadway. With just light compaction, fill has room to expand, virtually eliminating damage caused by swelling from water absorption and subsequent freezing.

Each anchor 14 (FIG. 3) includes a vertical center section 18, a horizontal top portion 20 and a horizontal bottom portion 22. The vertical center section 18 may be circular or square in shape and is of sufficient cross-section to support the full weight of an entire lane section 16 (e.g., one lane section supported by at least two anchors at opposing ends of the lane sections).

The top and bottom sections 20, 22 are each fabricated with a lateral step or notch 24, 26 on one end and a complementary step or notch 28, 30 on an opposing end. Construction of the anchors 14 with notches 24, 26, 28, 30 allows adjacent anchors of a highway system 10 to be joined, thereby increasing the stability of the highway system 10 (and provides self-alignment).

To join adjacent anchors 14, holes 32, 34, 36, 38 are provided through opposing ends of the top and bottom portions 20, 22. Bolts 40, 42 (FIG. 2) pass through and join adjacent anchors 14 of the highway section 12.

To build the prefabricated highway system 10, a road-builder merely excavates to a depth sufficient to reach a stable subsoil (below the frost line in temperate areas) and places the anchors 14 at appropriate intervals. Bolts 40, 42 are used to join top and bottom sections 20, 22 of adjacent anchors 14 together to increase the lateral stability of the anchor assembly. Pylons 44 are driven through a set of holes 46 (FIG. 3) in the bottom portion 22 of each anchor 14. Water mains and electrical conduit 73 may be placed in the interstices of the anchors parallel to the roadway before the area around the anchors 14 is backfilled. Likewise, storm sewers 71 (FIG. 4) may be placed adjacent the roadway on either side. Once storm sewers are installed, they are backfilled, just like the anchors. This fill needs a greater level of compaction than does the fill around and between the anchors 14.

The storm sewers 71 may either be directly buried adjacent the highway system 10 or a prefabricated concrete roadside section 80 may be placed adjacent the lane sections 16 before backfilling. Where a roadside section 80 is used, drain pipes 86 may be included into the roadside sections 80 to interconnect grates placed at the edge of the highway system 10 and the storm sewers 71. Receptacles may also be provided in the roadside section 80 for road signs 88.

Figure 4:
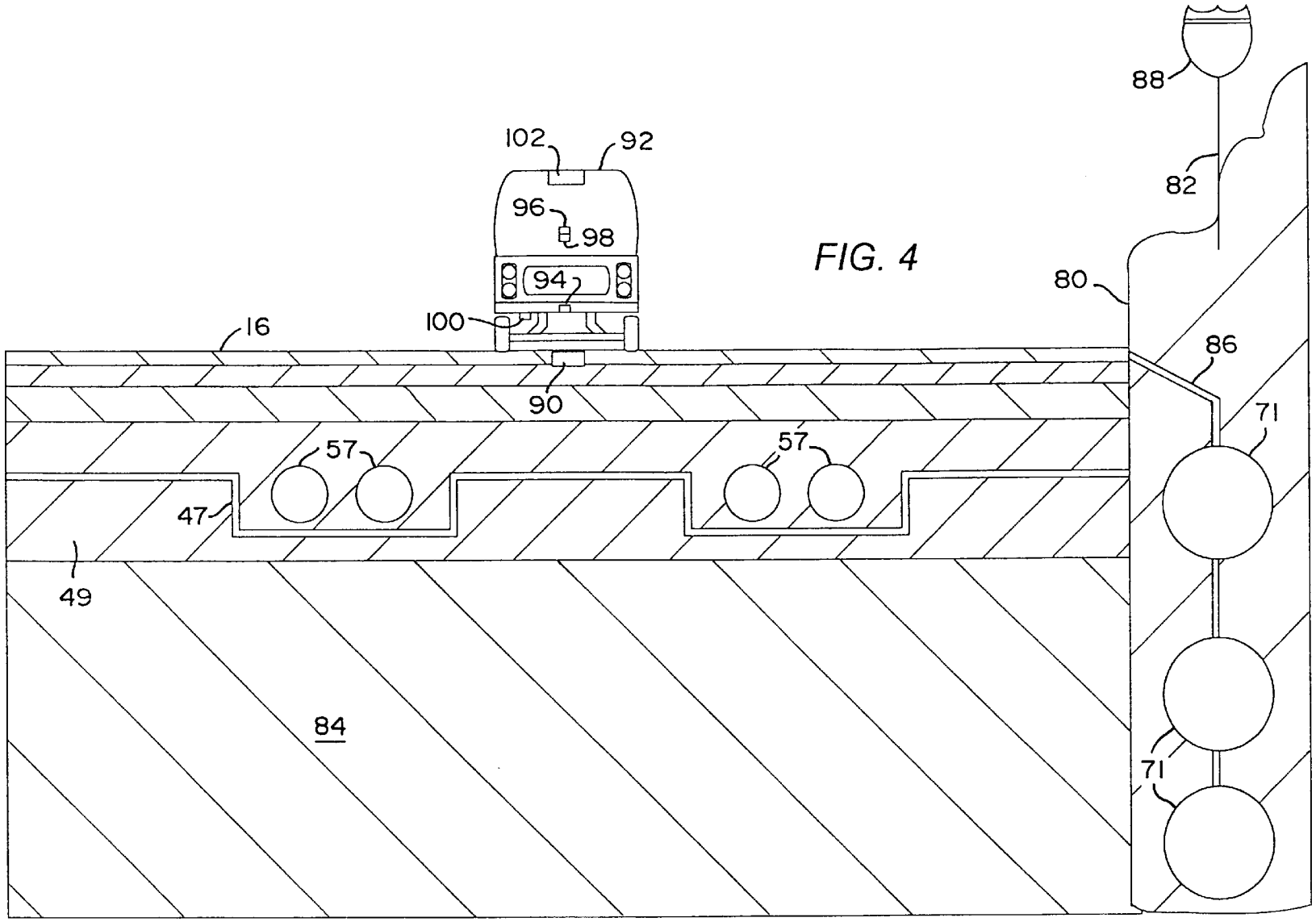
FIG. 4 is a sectional view of the highway of FIG. 1.

Following placement of the anchors 14, the area around the anchors 14 is backfilled to a level substantially level with a top of the anchors 14 with a loosely compacted fill 84 (FIG. 4). The backfill does not have to be compacted to any significant degree since the backfill is not a significant factor in the support of the lane sections 16 placed on top of the anchors 14.

A chemical insulation 49 (FIG. 4) may be injected below the lane sections 16, which expands, hardens and fills the void between the fill and lane section 16. This chemical layer 49 provides shock, vibration and noise isolation. It creates an impervious moisture and vapor barrier, while acting as a brace, preventing movement of the road surface between anchors 14. It prevents frost heaves and protects the underside of the roadway.

The lane sections 16 and anchors 14 are constructed in a manner well known in the art of bridge construction. What differentiates the highway system 10 from the prior art, inter alia, is the use of the lane sections 16 and anchors 14 in the context of a prefabricated highway, the standardization of the lane sections 16 and anchors 14 and the installation of the prefabricated highway system 10 over all types of terrain.

Further, the highway system 10 is at ground level, not over water or other roadways, hence there is less need for over-engineering. Bridges are normally built to withstand extreme conditions (and load capacities several times greater than the maximum expected loads). The prefabricated highway system 10 described herein does not need this level of over-engineering since it's components are at ground level.

The lane sections 16 are similar to prefabricated walls used in the construction of commercial complexes (e.g., office buildings, warehouses, etc.). Like prefab walls, lane sections 16 are designed and built to carry specific loads under specific conditions. In addition each lane section may be delivered with a specific nameplate (in a bar coded format) permanently secured to the lane section 16 and readable with a bar code reader. The bar code may be used to uniquely identify the section, including manufacturer, date of original installation, repair dates, etc. The information of the barcode may reside in a permanent database and be constantly updated.

In addition to the pylons 44 driven through the bottom section 22 of the anchor 14, the prefabricated highway 10 also includes other provisions to secure the lane sections 16 to the anchors 14. Of particular interest is the use of ribs 47 disposed on a bottom surface of each lane section 16 along its length for purposes of retaining the lane section 16 within a corresponding slot 50 (FIG. 3) on either side of a center line of the supporting anchors 14. To reduce vibration, a vibration isolation material 48 (e.g., an elastomer, asphalt, macadam, tar, etc.) is disposed on a bottom surface of the rib 47.

Following installation of the anchors 14, the lane sections 16 are placed on top of the anchors 14 with the ribs 47 on the bottom of each lane section 16 engaging the notches 50 of an anchor 14. Lifting points 52 are provided for easy attachment of lifting cables and chains. The lifting points 52 may simply be holes passing completely through the lane sections 16, through which a cable may be passed (later covered with manhole covers), or threaded holes for special screw-in lifting lugs.

Gaps between lane sections 16 may be filled with a quick setting chemical material (e.g., epoxy) forming a chemical joint. Chemical joints provide smooth transitions between lane sections, eliminating vibration. They are less susceptible to weather, rust, fatigue and stress fractures than mechanical joints or metal joints. Chemical joints may also be used between lane sections 16 for smooth travel over dividers between lanes. Chemical joints are less susceptible to expansion problems than metal or mechanical joints, can be engineered to withstand both high and low temperatures and high and low moisture ranges and are impervious to weather. Chemical joint maintenance and/or replacement is also simpler. When sections need to be replaced, chemical joints can be cut open using conventional tools.

The lane sections 16 are fabricated of prestressed concrete of an appropriate width and thickness for the application. Prestressed concrete provides rigidity, stability and the ability to carry tremendous weights. It is less susceptible to vibration, flexing and bending under complex loading. Prestressed concrete can be constructed for different loading conditions (e.g., through the use of more (or thicker) steel rods (re-bar), or prestressed cable, thicker concrete substrates, varying cement compositions, etc.).

The surface 55 of each lane section 16 may also be engineered for the application. For example, the surface may be a replaceable asphalt layer, with specific characteristics tailored to meet expected roadway conditions. The asphalt layer can either be prefabricated and applied at the factory, or laid down using existing machinery and exiting techniques.

The texture of the surface 55 may also be engineered for the application. Straight highway sections may be given a relatively smooth surface to reduce road noise and improve surface durability. Curved sections of the highway system 10 may have longitudinal grooves to reduce the incidence of hydro-planing under wet conditions.

The surface 55 of the lane sections 16 may also be layered to provide a visual indication of surface wear. Under the embodiment, the surface 55 may comprise a first upper layer 53 of conventional black asphalt over a second layer 54 of colored (e.g., red) asphalt. As the layer of conventional asphalt 53 wears away the warning layer 54 of colored asphalt gives visual indication of a need for road maintenance.

The surface 55 of the lane sections 16 may also have pre-applied lane markers 70. Lane dividers 72 may also be provided as part of the lane sections 16 to protect drivers from oncoming traffic.

Further, the highway system 10 may be prewired with sensors 56, 58, 59, 60, 61, 62, 64 for monitoring roadway performance and the need for corrective action. Electrical conduits 57 consisting of hollow tubes running the length of the lane sections 16 within the ribs 46 may collect the wiring for the sensors and route the signalling information to a common monitoring location. Fine wires 56 running transversely to traffic flow may be embedded within the conventional asphalt layer 53. As the asphalt layer 53 wears away, the fine wires would also be worn away presenting an open circuit condition to a monitoring facility.

Temperature sensors 59 may be embedded within the asphalt 53, 54 to monitor road temperatures. When the temperature drops below freezing, a warning may be displayed to users of the highway system 10 warning of the possibility of slippery conditions.

A first set of strain gauges 61 may be attached to, or embedded within, critical structural portions of the highway system 10 not only for purposes of detecting overloads but also to detect deterioration of the structural integrity of the highway system 10. The passage of heavy (overweight) trucks can be tracked by readings from the strain gauges 61. The highway patrol can be dispatched to a road section with a high weight reading as indication that a truck present on the section may be overloaded. Further, any lane section 16 providing a consistently high reading may be an indication of section deterioration and the need for repair. Such readings could be used to dispatch repair crews.

To monitor for more serious conditions other sensor systems could also be incorporated into the highway system 10. Shock sensors (accelerometers) 60 may be embedded within the asphalt layers 53, 54 to detect the growth of potholes. Again, repair crews could be dispatched when readings of a particular section exceed some threshold value.

A second set of sensors 62, 64, 66 may be provided beneath the lane section 16. Such second set of sensors may function as backup devices for the strain gauges 61 and shock sensors 60 within the lane sections 16 as well as provide additional environmental monitoring (e.g., moisture beneath the lane sections). Environmental monitoring may be useful in preventing damage to the bottom of the lane sections 16.

The second set of sensors 62, 64, 66 where implemented in the form of strain gauges also provides a unique opportunity for detecting catastrophic failure. Such detectable failures include that of collapse of lane sections 16 as well as deterioration of anchors 14 supporting the lane sections 16.

Where a serious problem is detected such as lane collapse by the second set of sensors 62, 64, 66 or a less serious problem such as a pothole detected by a shock sensor 60, a controller (not shown) at a department of transportation facility (also not shown) may cause a lane closure via an announcement displayed on an overhead sign 76 (FIG. 1). Such lane closures may effect part of the highway system 10 (e.g., a single lane) or the entire system 10. Where such closures occur, the overhead sign 76 may by used to reroute traffic by displaying information as to where to exit and return to the system 10 to avoid bottlenecks and dangerous driving conditions.

To improve safety of traffic flow, a navigational cable 90 (FIG. 4) may be embedded in the lane section 16 proximate the center of each driving lane. The navigational cable 90 may be used to transmit a high frequency signal that may be detected by a directional antenna 94 on the underside of a vehicle 92 using the highway system 10. Where the directional antenna is secured to the center of the underside of a vehicle, the direction of the high frequency signal from the antenna may be used to steer the vehicle down a center of the driving lane by a vehicle controller 102 using techniques which are well known in the art.

Radio frequency signals unique to each particular lane section 16 may be transmitted through the navigational cable 90 identifying the lane section 16 to the controller 102 and, hence, the vehicle's geographical position on the highway system 10 using technology that is well known in the cellular arts. Localized control information, such as notification of the approach of a highway exit, may be provided by segmenting the navigational cable 90 near highway exits. Such signals may be transmitted as a sideband of the navigational frequency, or the navigational frequency may be frequency modulated onto a carrier signal along with control information.

Compact radar transmitters 96, 98 located on a front and rear of the vehicle 92 may be use by the controller 102 to maintain a safe spacing between the vehicle 92 and other vehicles using the highway system 10. Speed sensors 100 mounted to the vehicle may allow the controller 102 to maintain safe vehicle speeds.

Figure 5B:
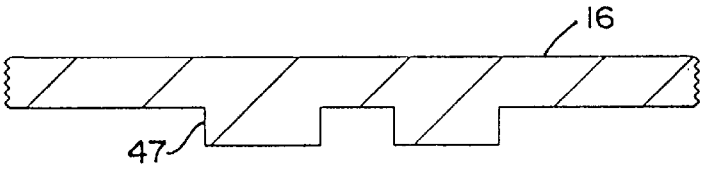
FIG. 5 is another embodiment of the anchor of FIG. 1.
Figure 5A:
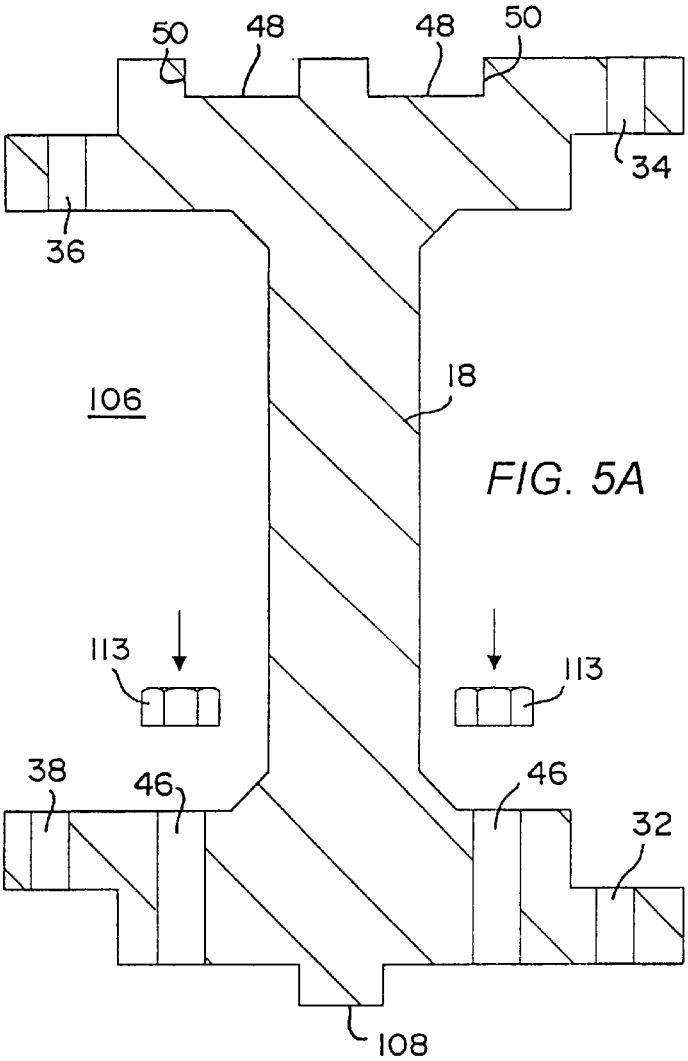
Figure 5C:
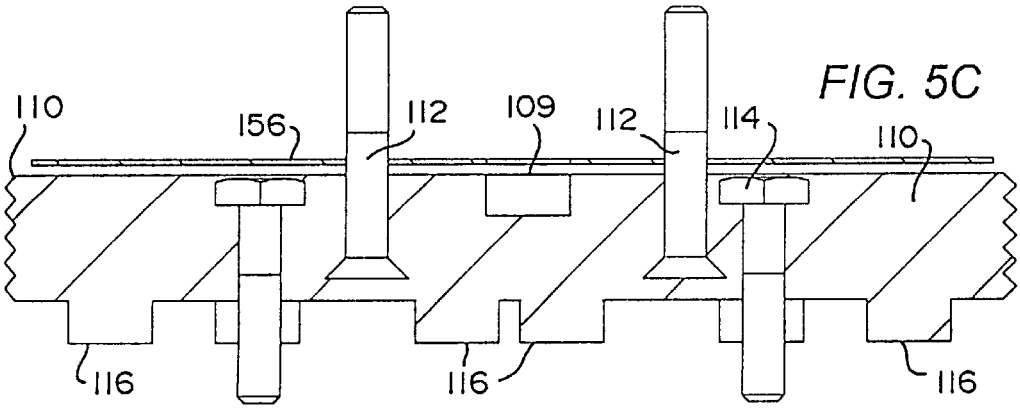

In another embodiment of the highway system 10 of FIG. 1, the anchor 14 of FIG. 3 is equipped with a bottom rib 108 (FIG. 5) and supported by a concrete base 110. A complementary notch 109 is provided in the base 110 to receive the rib 108 of the anchor 106. Bolts 112 permanently embedded in the base 110 secure the anchor 106 to the base 110 and, together with the rib 108 and notch 109, stabilize the anchor 106 to the base 110.

Pylons 114 within the base 110 are driven into a supporting earth and support the base 110. Ribs 116 on the bottom of the base 110 further stabilize the base in the supporting earth.

Figure 6A:
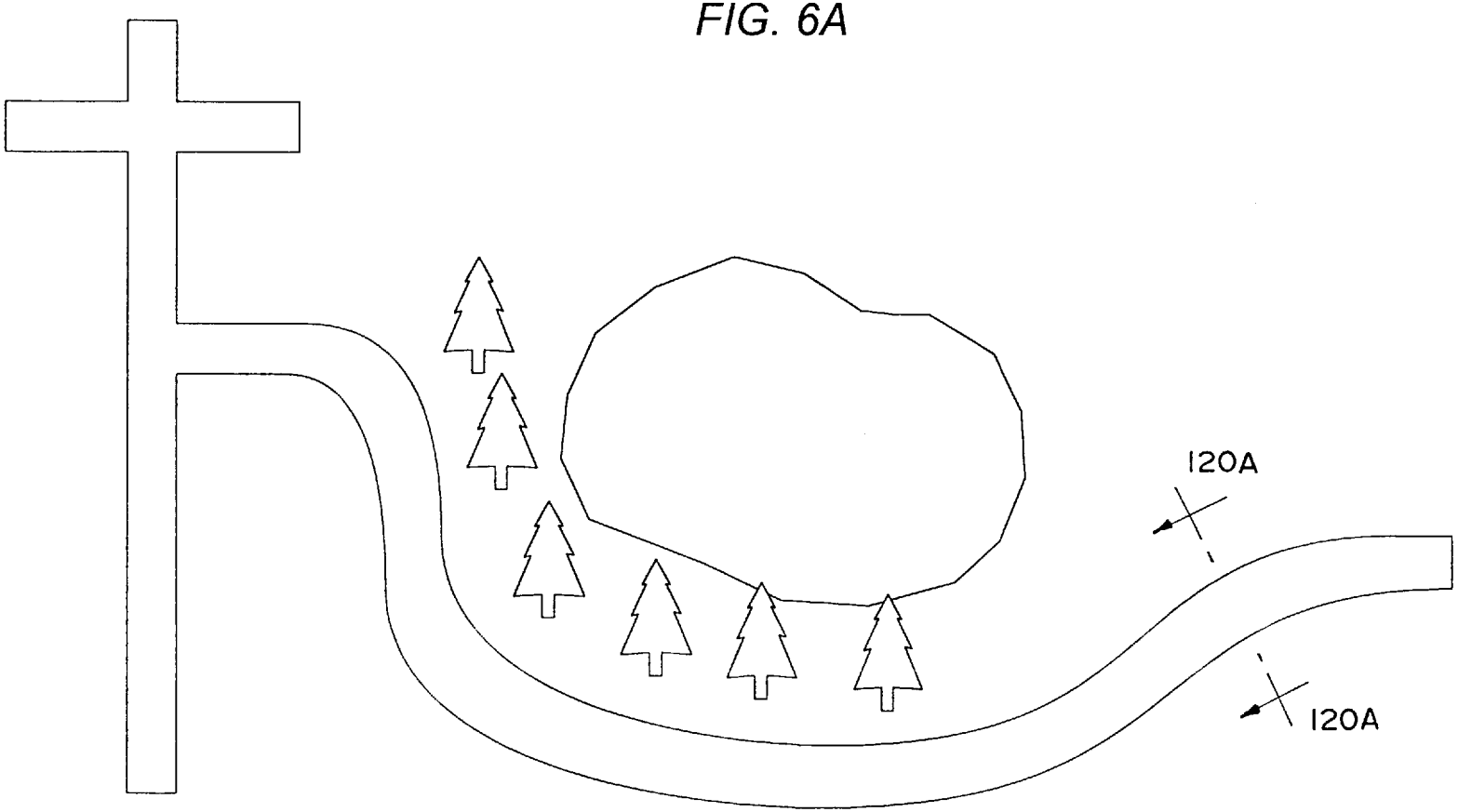
FIGS. 6A–6F depict construction steps for constructing the highway of FIG. 1.
Figure 6B:
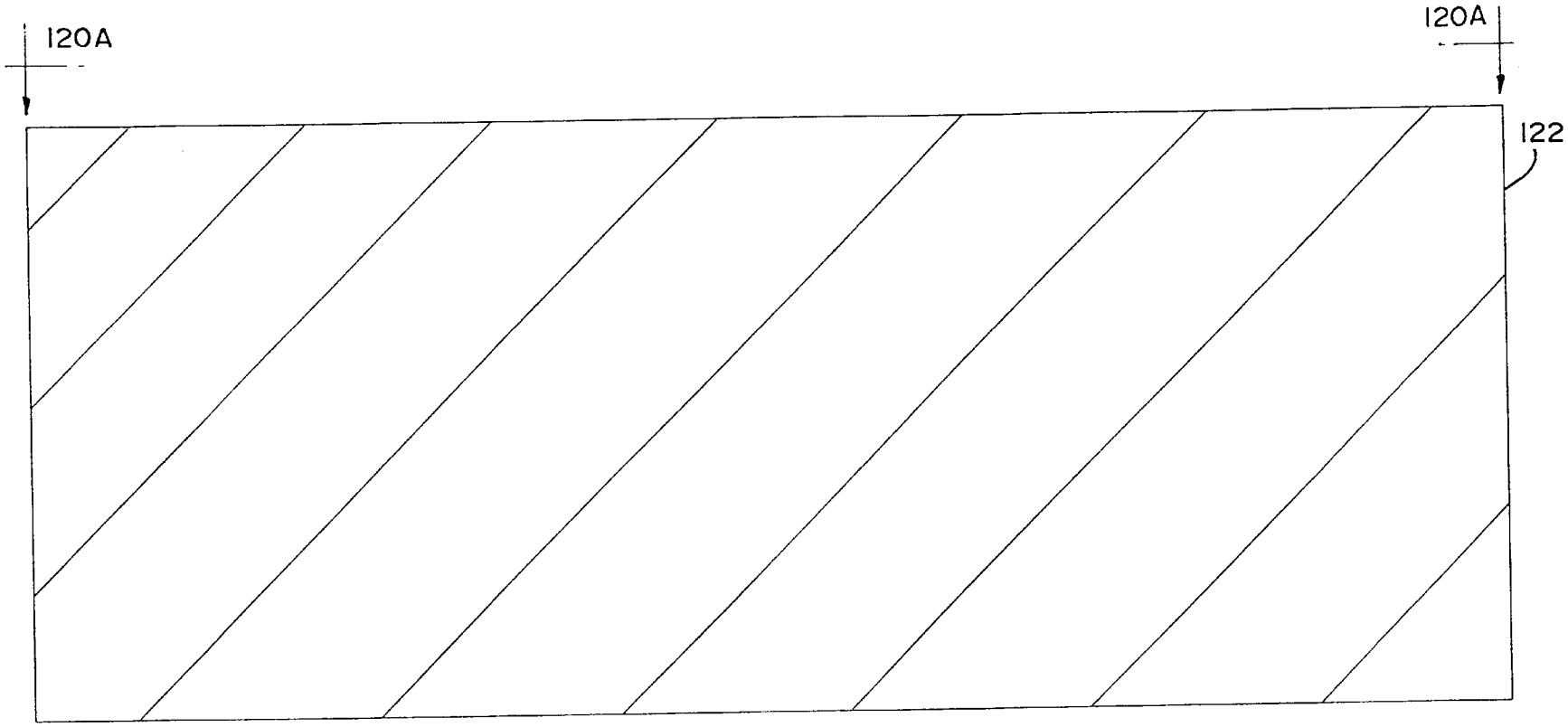
Figure 6C:
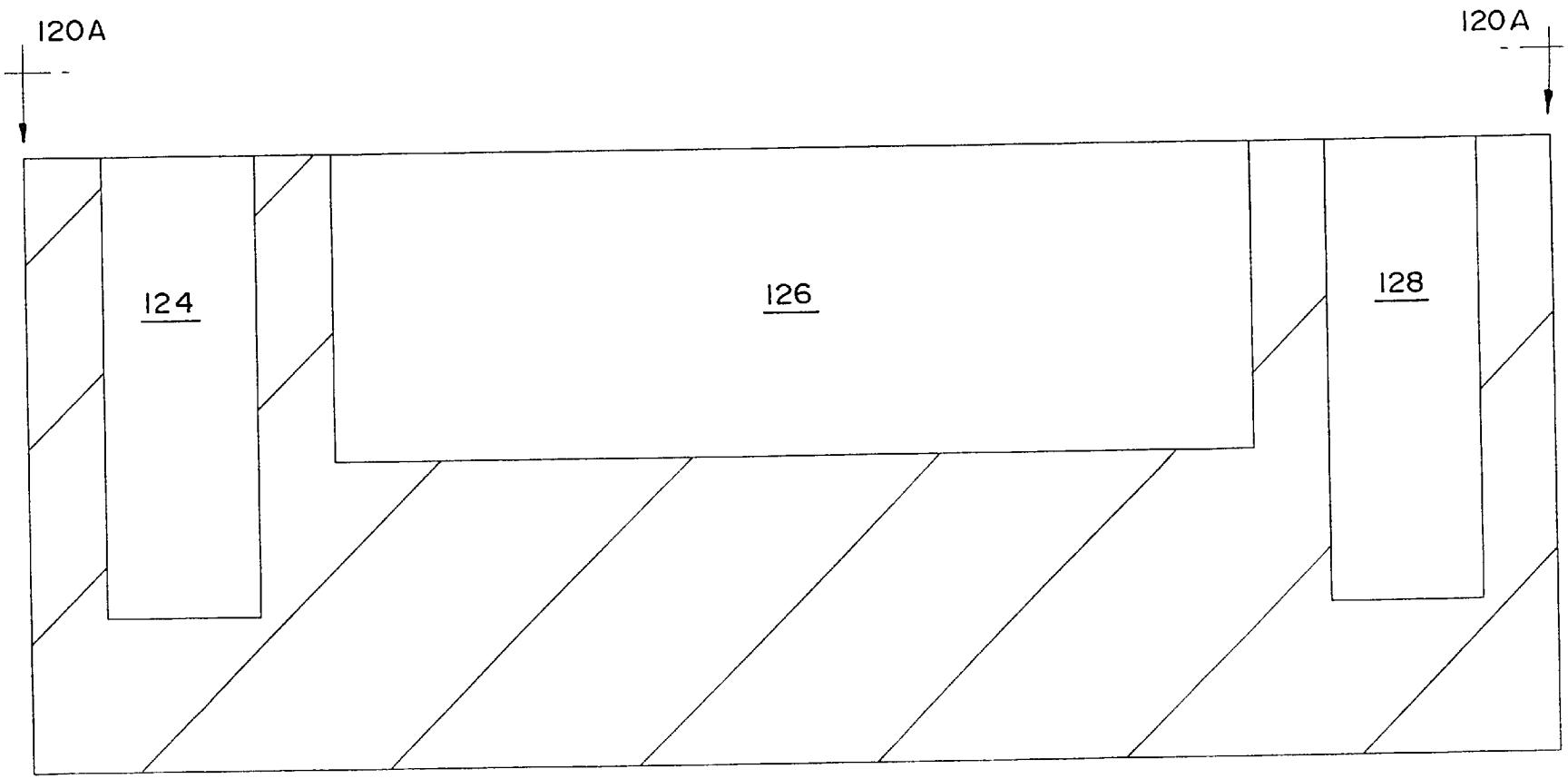

FIGS. 6A–6F depict a series of steps that may be used for construction of the highway system 10. FIG. 6A depicts a planned route 120 for a highway to be constructed using the novel prefabricated highway system 10. FIG. 6B depicts a cross section of the highway route 120 before construction beings. FIG. 6C depicts excavation of the route 120 required for construction of the system 10. As shown, a central area 126 may be excavated for placement of anchors 106 of a lane section 16. Two narrow trenches 124, 128 may be excavated on each side for installation of storm sewers.

Figure 6D:
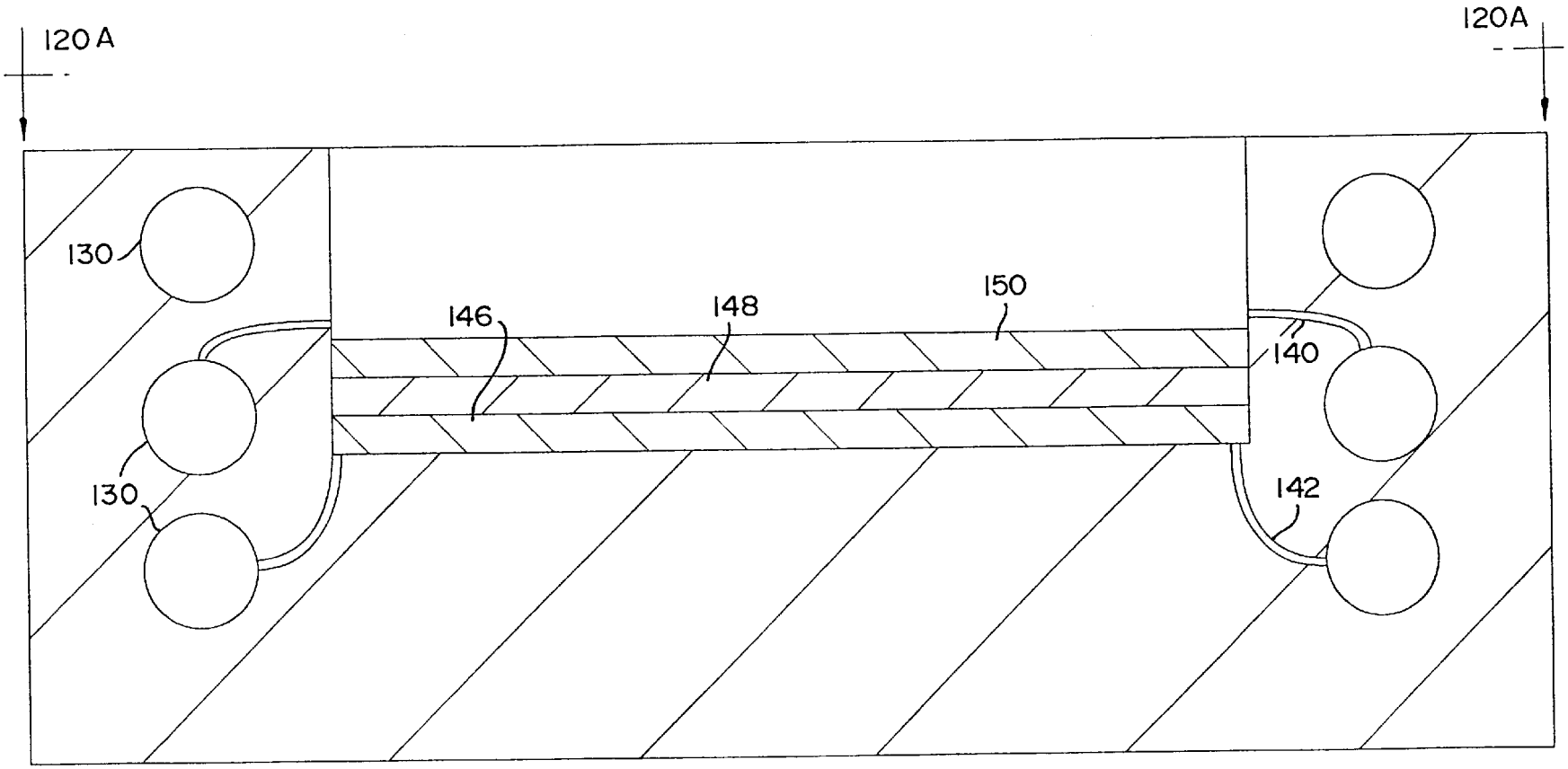

FIG. 6D shows a completed installation of the storm sewers 130. As shown, three layers of pipes are used for water collection; a lower level, a middle level and an upper level. Interconnecting piping 142 interconnects a lower part of the trench with the lower pipe of the storm sewer 130. A second interconnecting pipe 140 interconnects a middle part of the trench 126 with a middle pipe of the storm sewer 130.

Also shown in FIG. 6D is three layers of compacted fill 146, 148, 150. The lower level of fill 146 is a coarse layer of aggregate. The middle layer 148 is an intermediate layer and the upper layer 150 is a fine layer of aggregate.

Figure 6E:
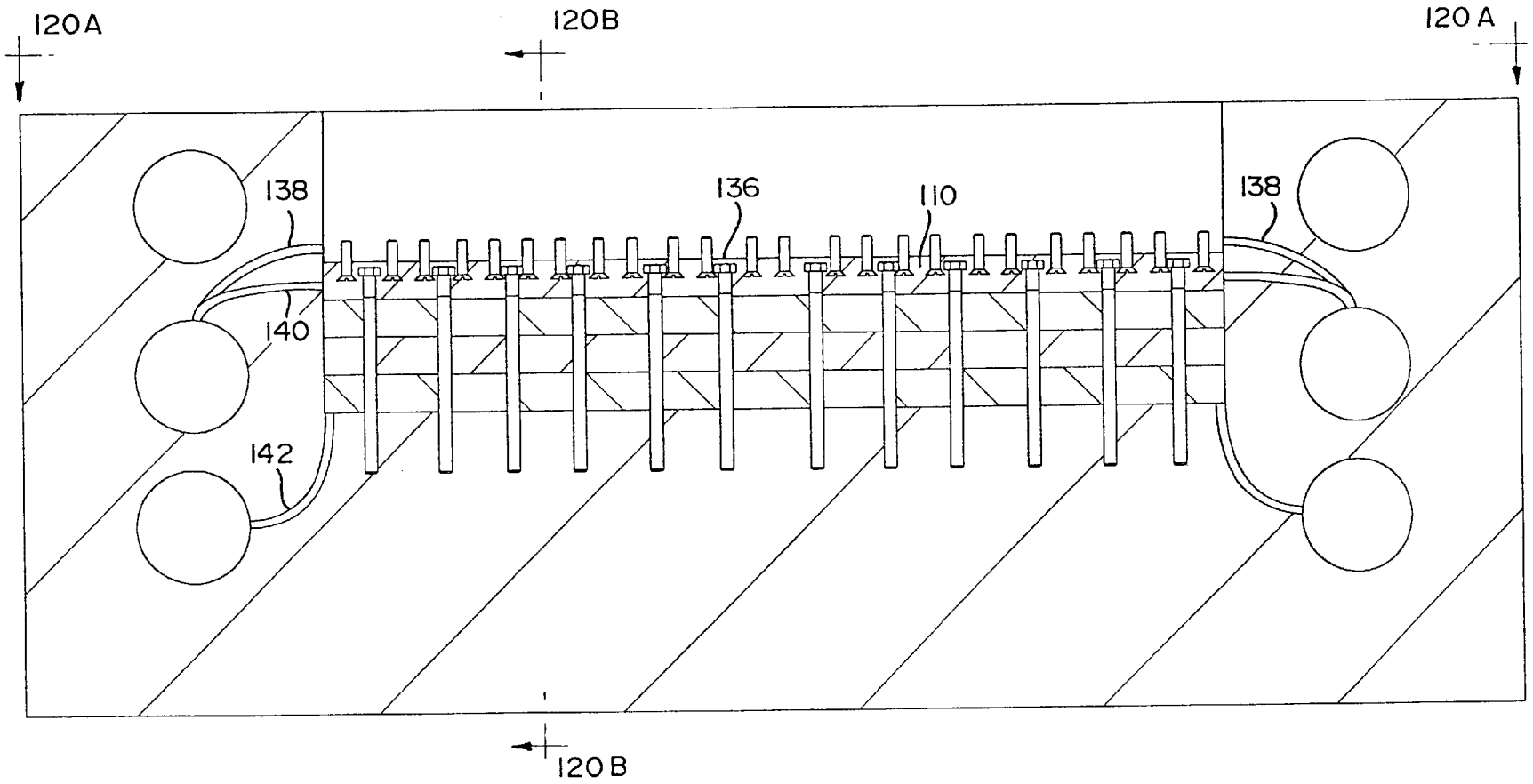
Figure 6F:
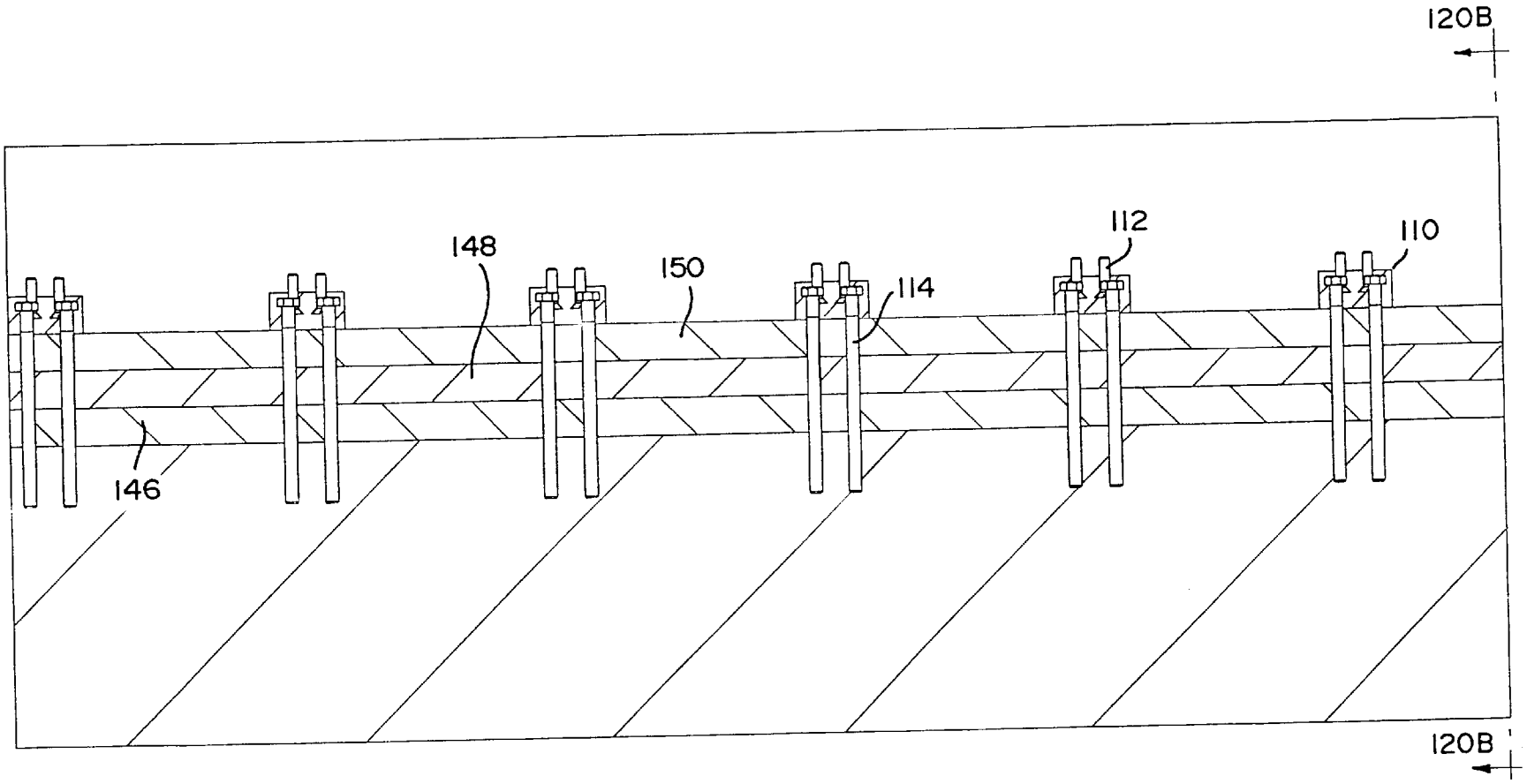

Following installation of the compacted aggregate, the concrete bases 110 may be set in place in the trench 126. Pylons 114 are driven through the basis 110, as shown in FIG. 6E and the sectional view of FIG. 6F.

Figure 7A:
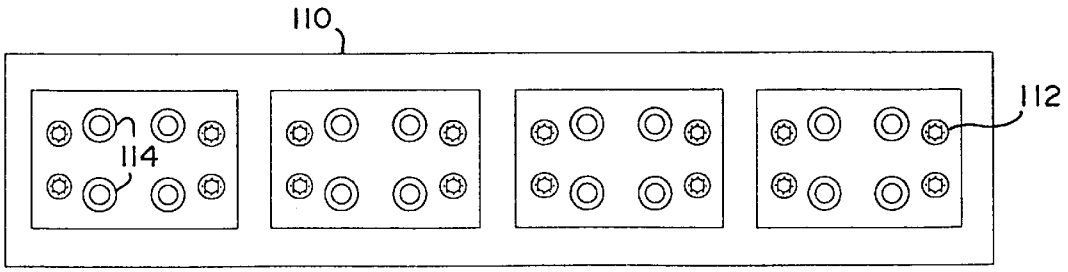
FIGS. 7A–7C depict detail construction steps for the construction of the highway of FIG. 1.
Figure 7B:
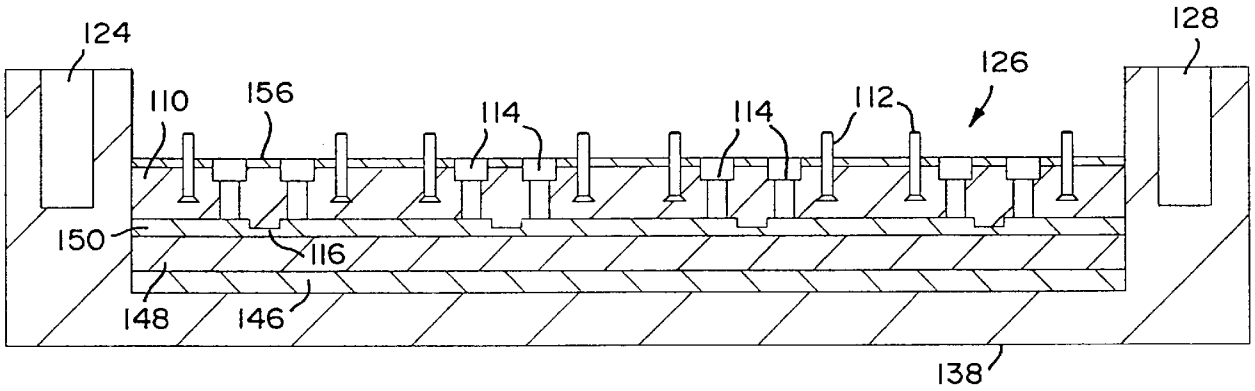
Figure 7C:
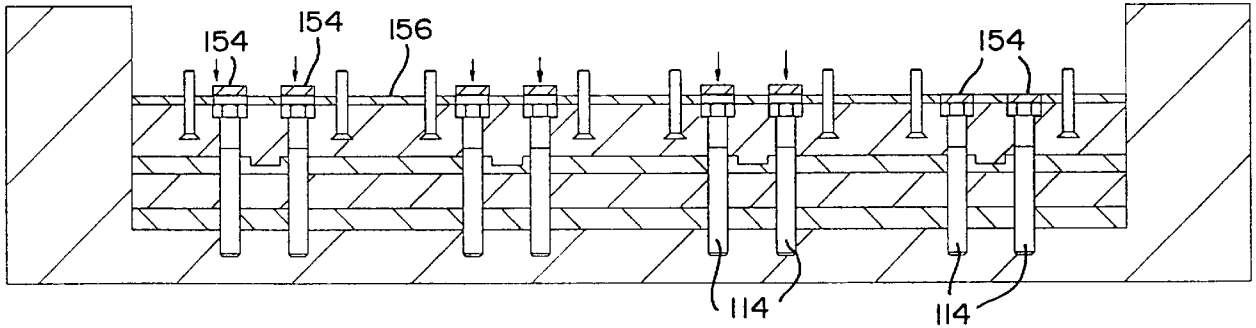

FIGS. 7A, 7B and 7C provide additional detail of anchor installation. FIG. 7A and 7B show a top and side view of the trench 126 with concrete bases 110 set in place. Holes 114 are shown in the bases 110 for installation of the pylons 114. FIG. 7C shows the bases 110 after installation of the pylons 114. Following installation of the pylons 114, covers 154 are placed over the holes 114 through which the pylons 114 have been driven. Finally, a layer 156 of an elastomeric material (e.g., asphalt, macadam, tar) is placed over the bases 110 and covers 154. The layer 156 functions to isolate the bases 110 from shock associated with traffic on the highway system 10.

Following installation of the bases 110, the anchors 106 may be set in place (FIG. 5) on top of the bases 110, over the upright bolts 112 and with the rib 108 of the anchor 106 engaging the notch 109. Nuts 113 may be used to secure the anchor 106 to the base 110.

Figure 8A:
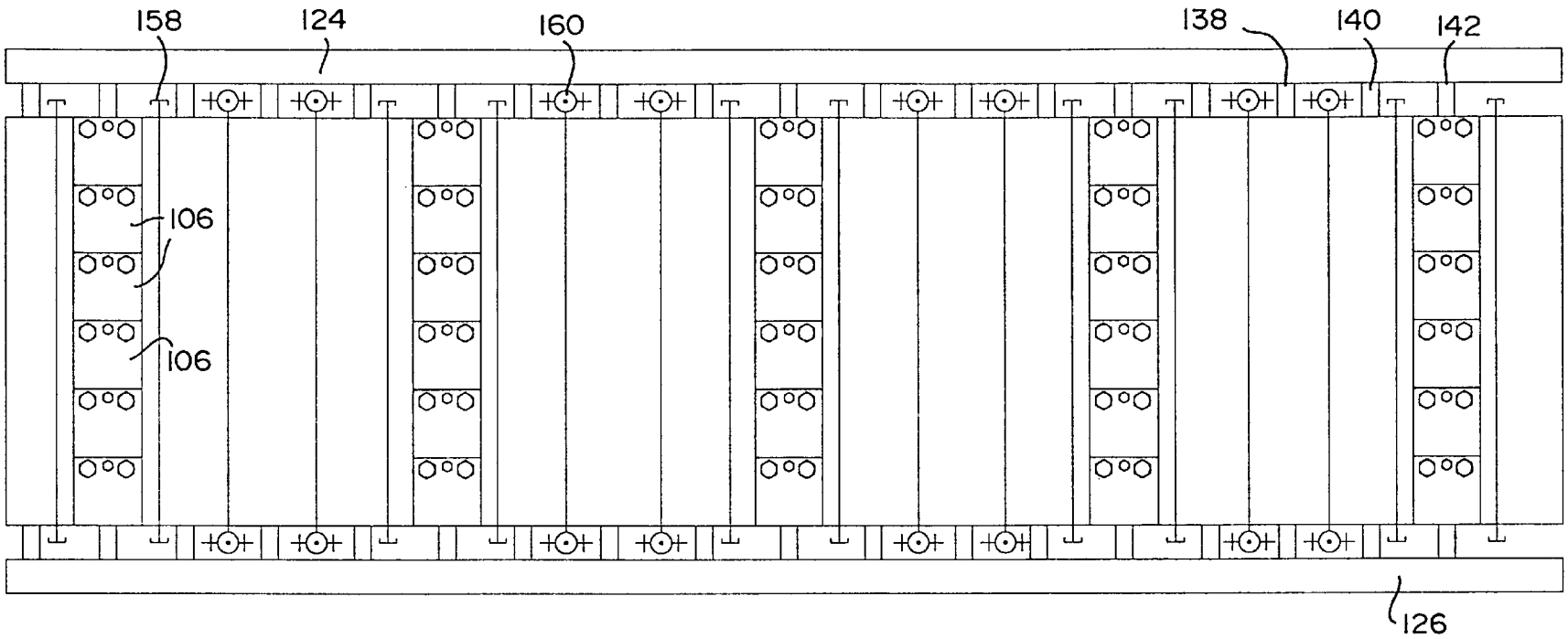
FIGS. 8A–8C depict construction steps for the construction of the highway of FIG. 1.
Figure 8B:
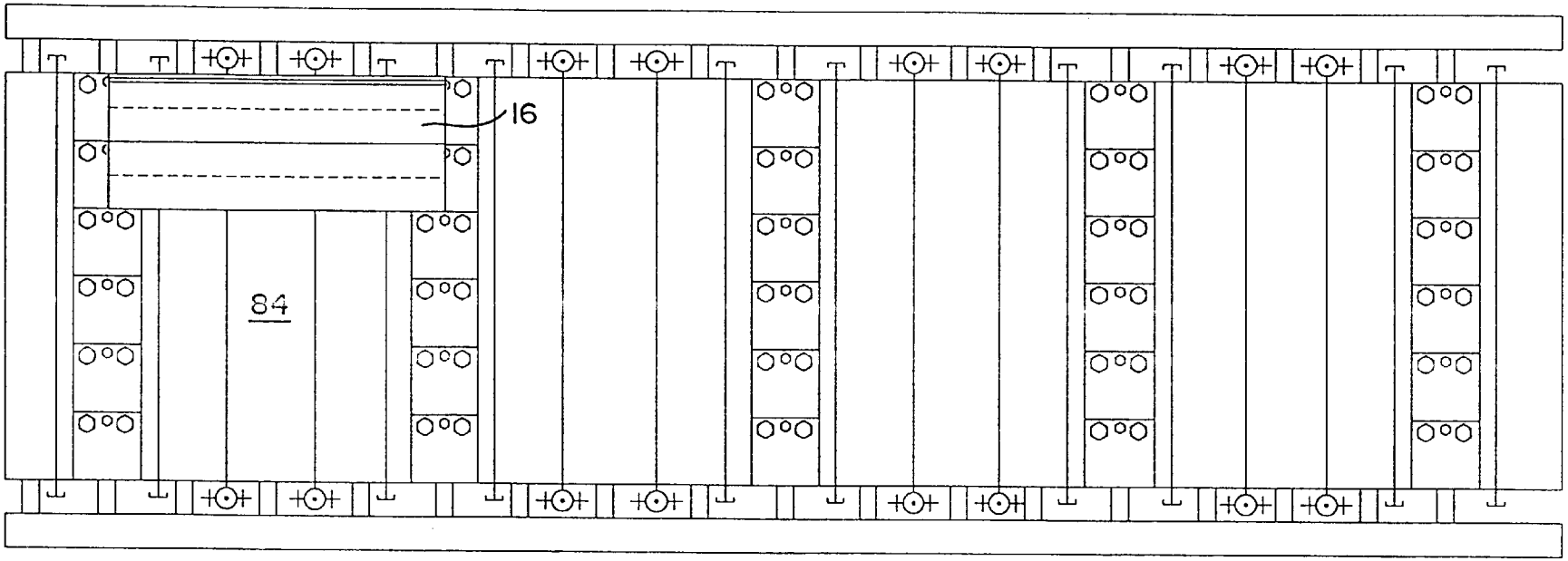
Figure 8C:
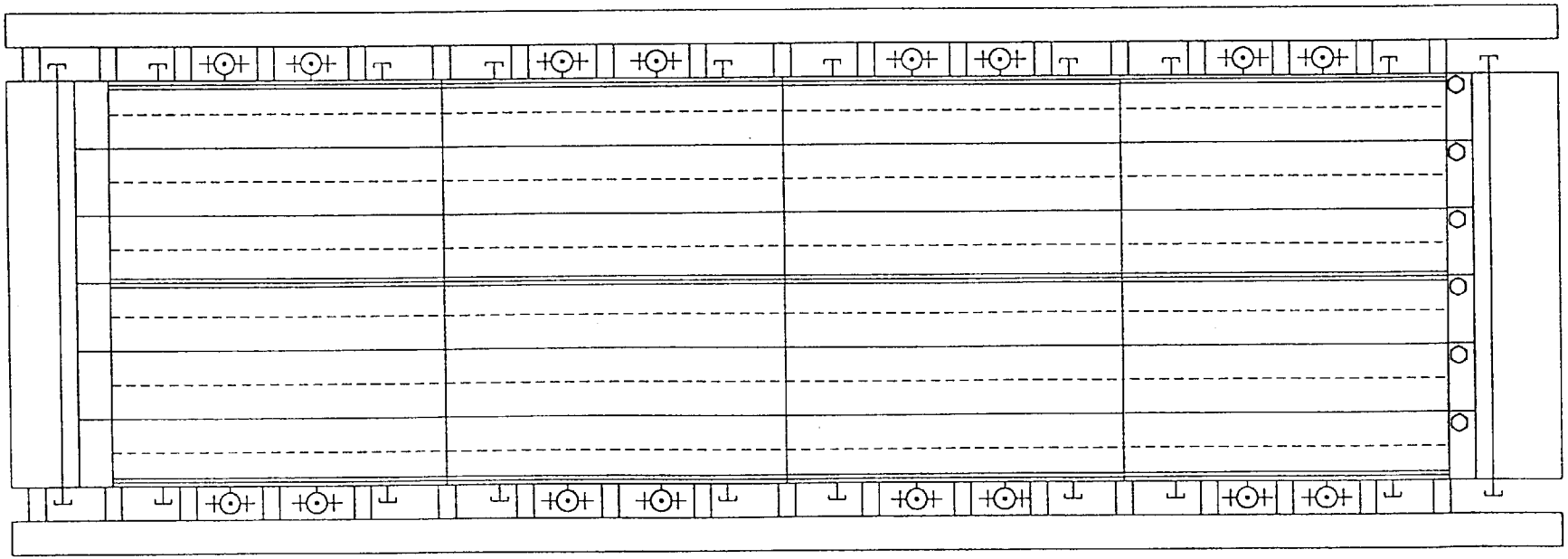

Following installation of the anchors 106, cross piping 158, 160 may be installed (FIG. 8A). The area around the anchors 106 may be surrounded by fill 84 and lightly compacted (FIG. 8B). Following the backfilling operation, the lane sections 16 may be placed on the finished anchors 106 (FIGS. 8B and 8C).

Figure 9A:
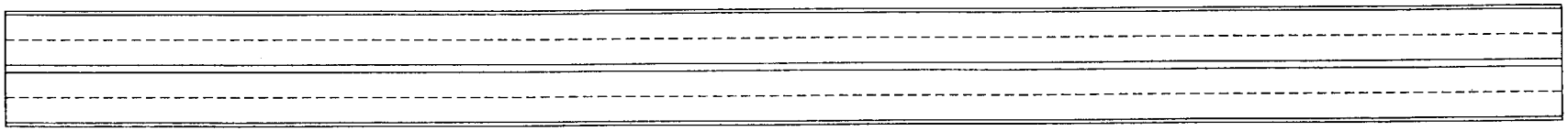
FIGS. 9A–9G depict construction steps for construction of the highway of FIG. 1 over an existing roadway.
Figure 9B:
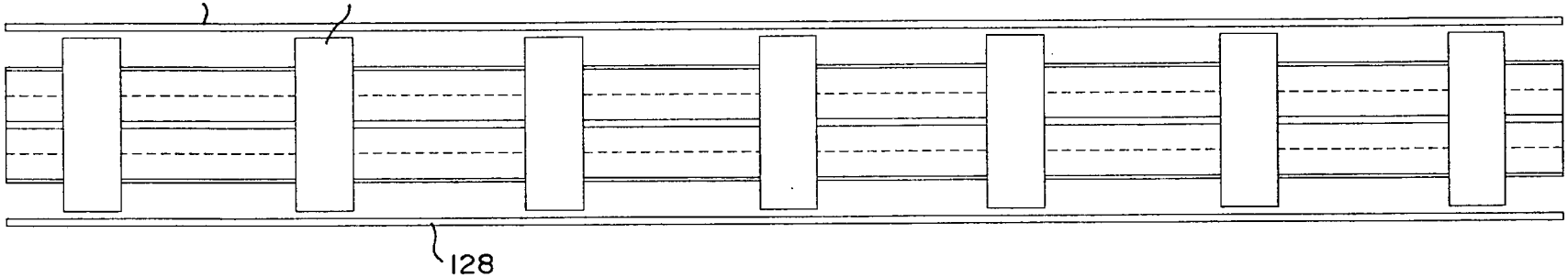

FIGS. 9A–9G shows the steps of installation of the highway system 10 over a pre-existing roadway. FIG. 9A shows the existing roadway before work begins. FIG. 9B shows the first step of excavation of anchor trenches 126. As is clearly shown, excavation may be limited to those areas where an anchor 106 is to be installed.

Figure 9C:
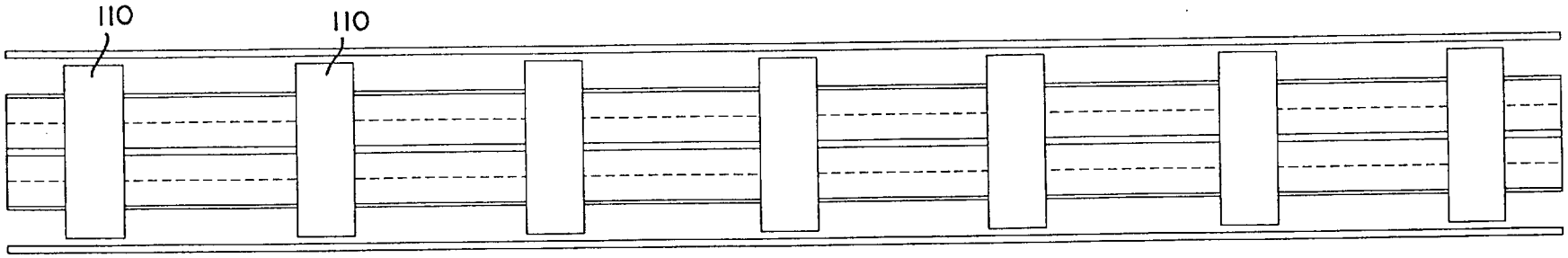
Figure 9D:
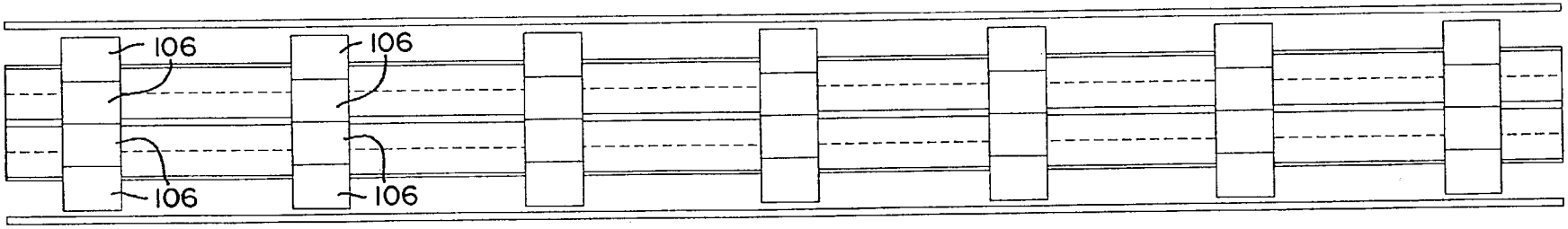
Figure 9E:
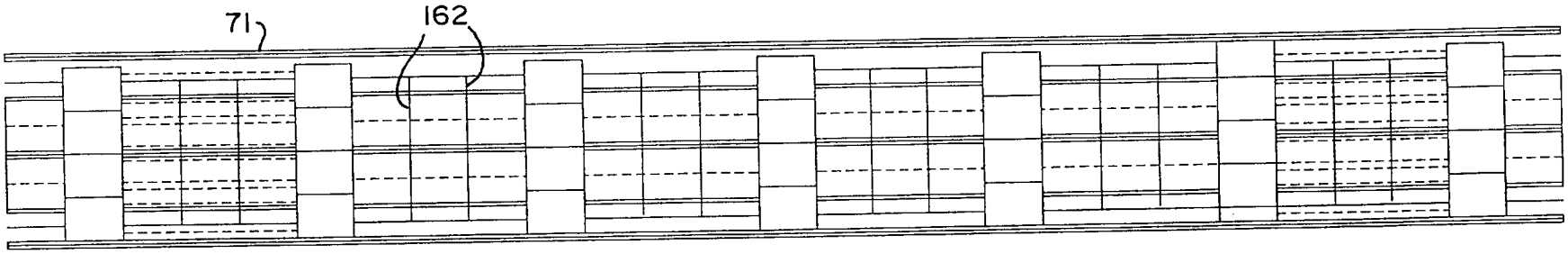
Figure 9F:
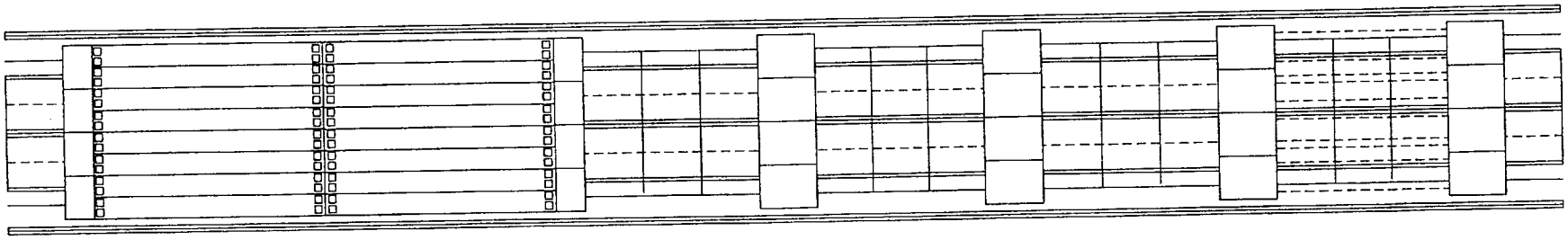
Figure 9G:
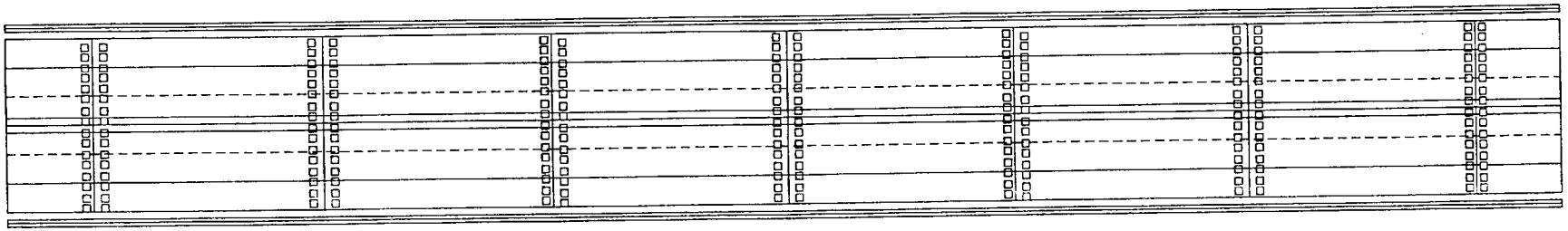

FIG. 9C shows the step of installing the bases 110 in the trenches 126. FIG. 9D shows the step of installing the anchors 106 in the trench 126 on top the bases 110. FIG. 9E shows the step of installation of cableway and piping 162. FIG. 9F shows completed highway system 10.

Figure 10A:
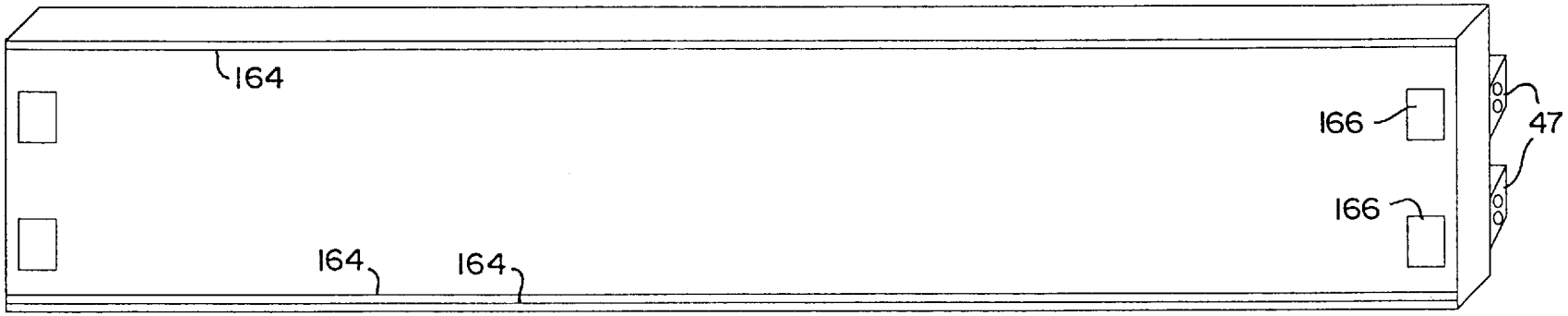
FIGS. 10A–10D depict construction details of electrical connections of the highway of FIG. 1.
Figure 10B:
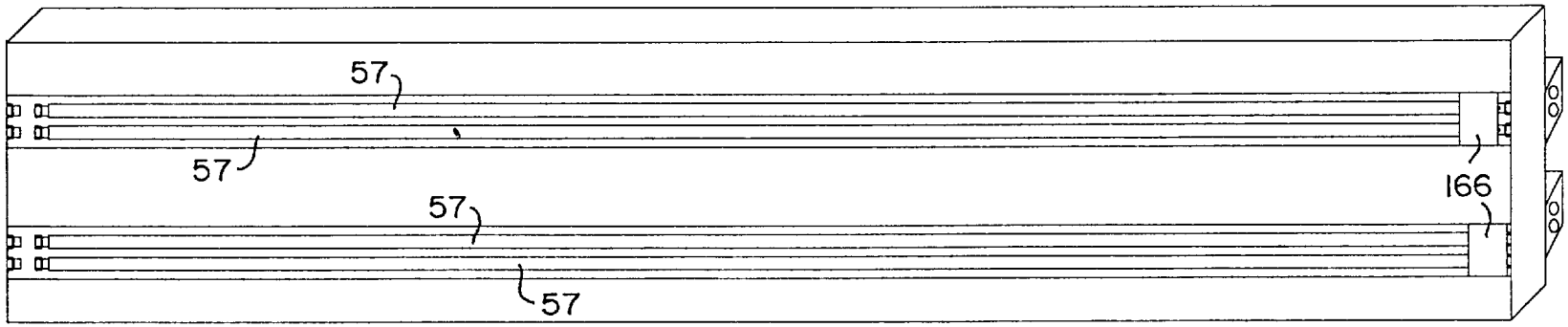
Figure 10D:
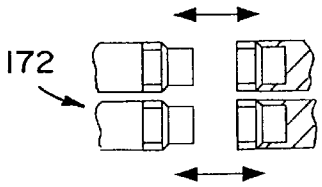
Figure 10C:
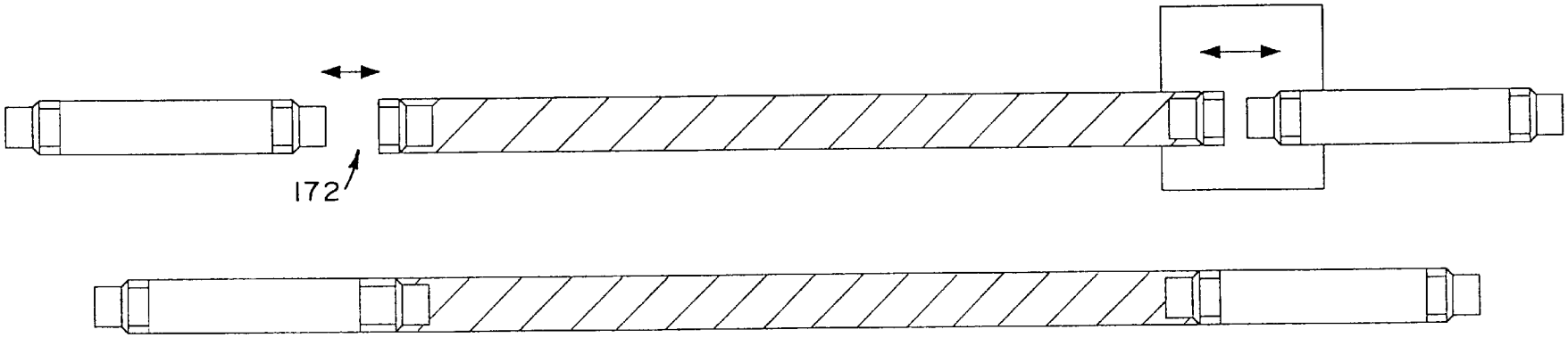

FIG. 10A shows a lane section 16 under an embodiment of the invention. As shown each prefabricated lane section 16 may be provided with individual lane markings 164. Each lane section may also be provided with individual re-closeable access holes 166 for access to conductors used for traffic and structural monitoring of the system 10. FIG. 10B shows the conduits 57 used to collect sensor leads for routing to a traffic control station (not shown). Also shown (FIGS. 10B and 10C) are quick connects 172 used to rapidly assembly the lane sections 16 and sensor arrays into the traffic monitoring system.

FIG. 11 is a diagram of an anchor 180 under another embodiment of the invention. Under the embodiment, the base 190 of the anchor 180 is made larger than a top 192 of the anchor 180. Increasing the size of the base 190 provides a larger surface area over which to distribute the load of the highway system 10.

The anchor 180 of FIG. 11 also contains an extra set of holes 188 through which a pylon 114 may be driven. The extra set of holes 188 are placed directly over a lower set of holes 184 so that a pylon 114 may be driven through both top and bottom sections 190, 192 of the anchor 180.

Figure 12A:
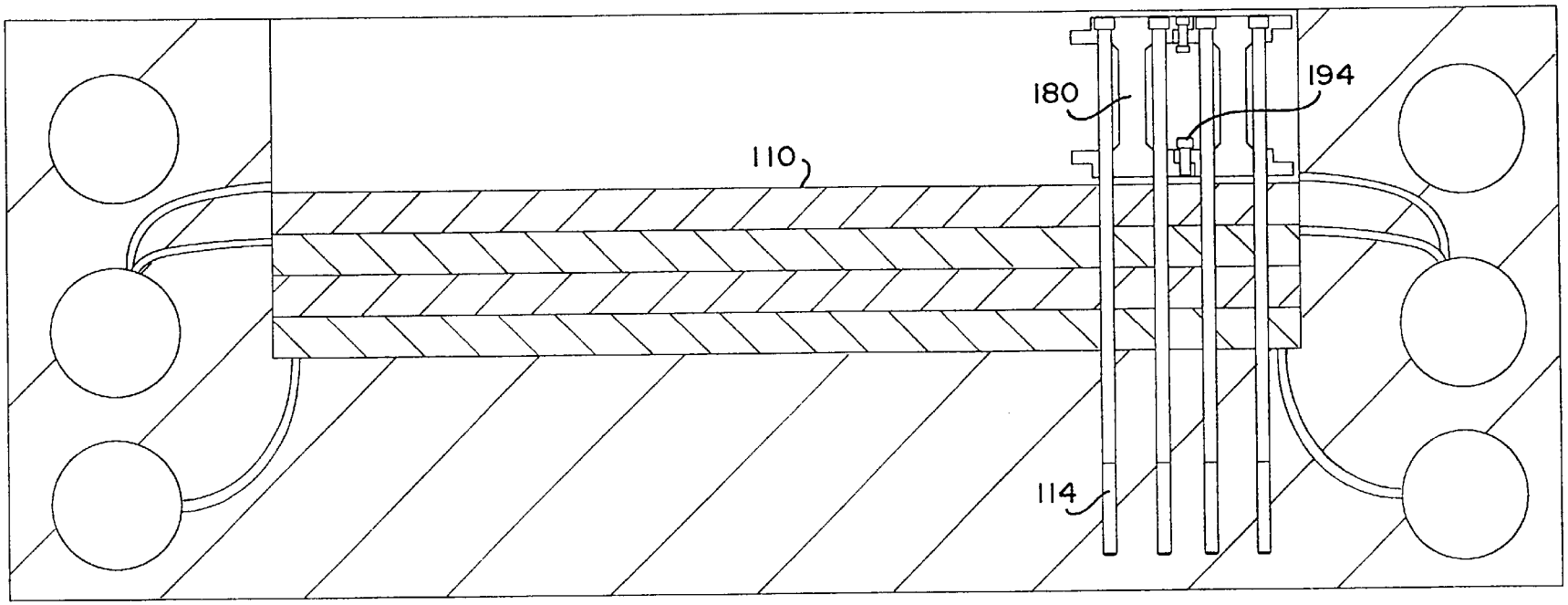
FIGS. 12A–12C depict construction details of another embodiment of the highway of FIG. 1.
Figure 12B:
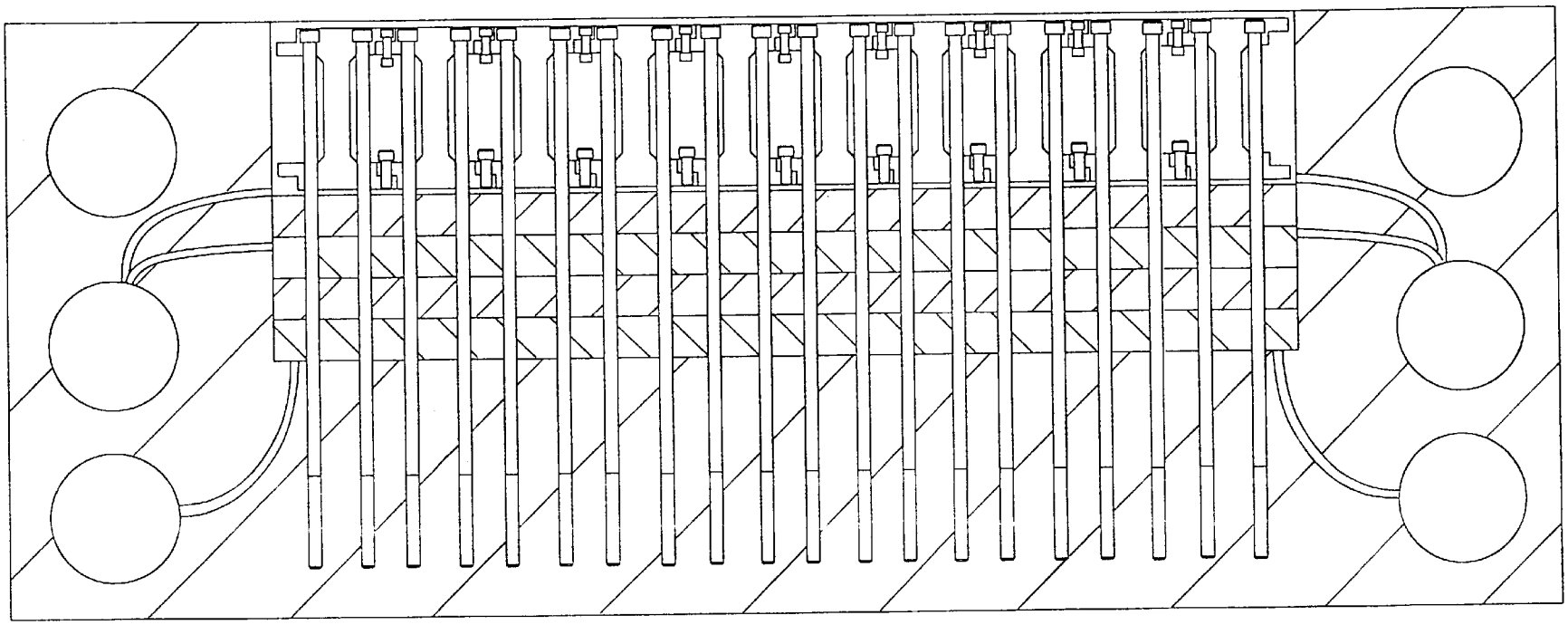
Figure 12C:
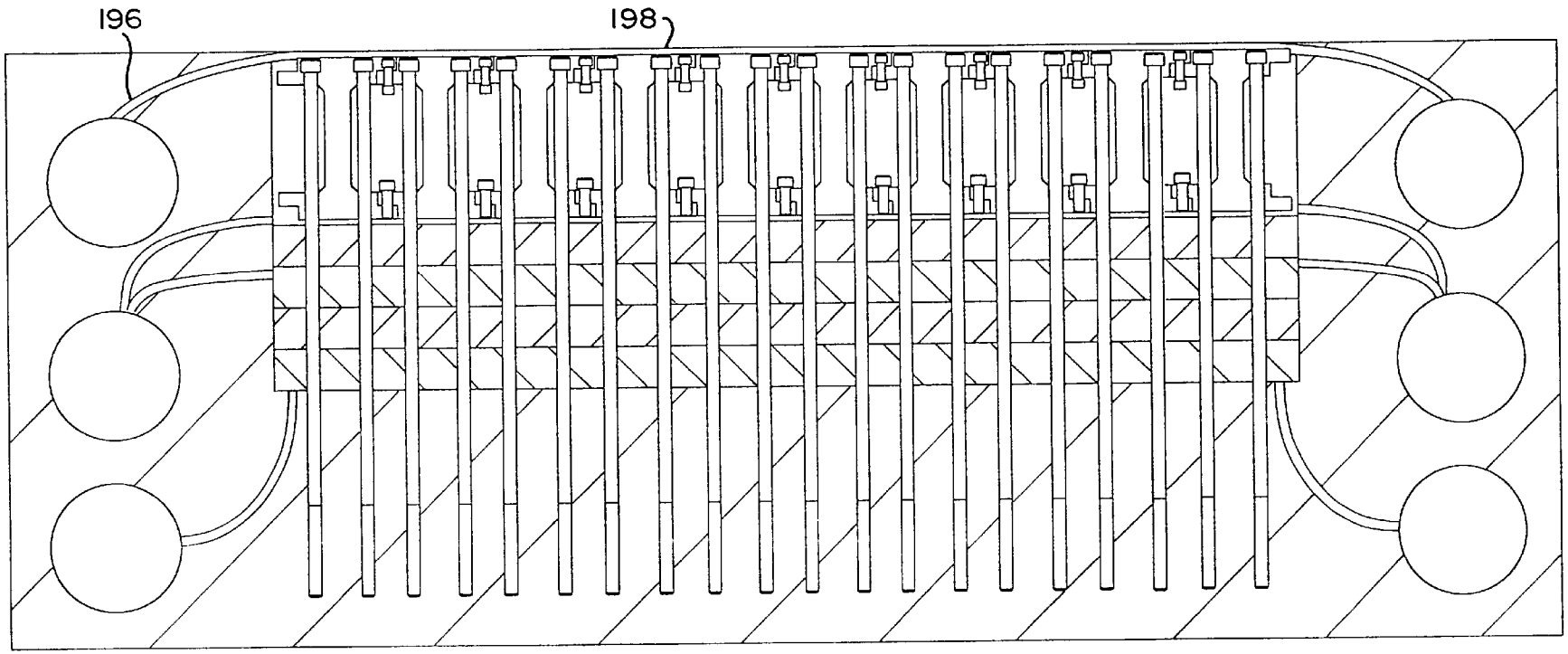

FIGS. 12A–12C show installation of the anchors 180 in a highway system 10. As shown (FIG. 12A) an anchor 180 may be set into place either on a base 110 or on a stable substrate of stable soil. The anchor 180 is secured to an adjacent anchor 180 through use of a bolt 194. Pylons 114 are then passed through an upper hole 188 and a lower hole 184, and optionally a base 110, before being driven into the supporting earth. As shown (FIG. 12B), the number of supporting anchors 180 may be limited only by the number of lanes to be included in the highway system 10.

Following assembly of the anchors 180 an uppermost drain 196 (FIG. 12C) may be added to drain water from the lane sections 16. An elastomeric coating 198 (e.g., asphalt, macadam, tar) may be added to isolate the anchors 180 from vibration from passing traffic. The highway system 10 (FIG. 12C) may then be completed as discussed above.

Figure 13A:
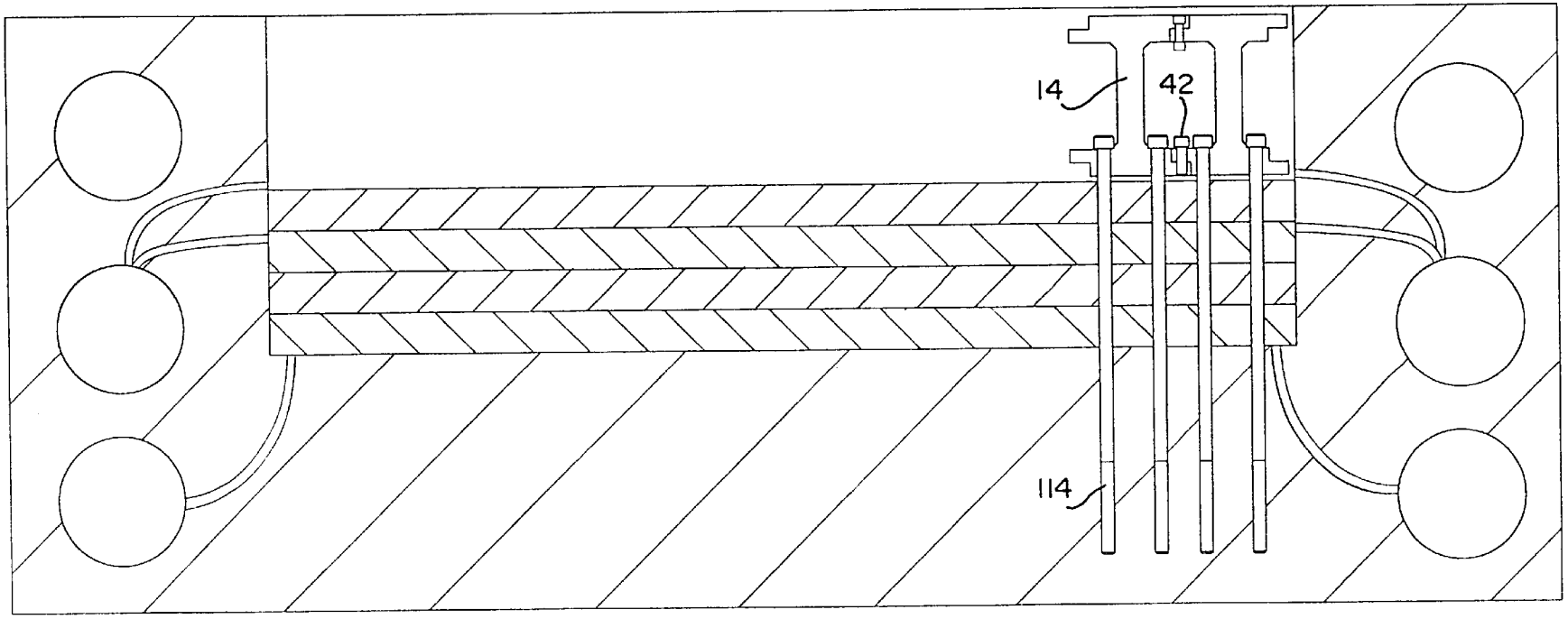
FIGS. 13A–13C depict construction details of another embodiment of the highway of FIG. 1.
Figure 13B:
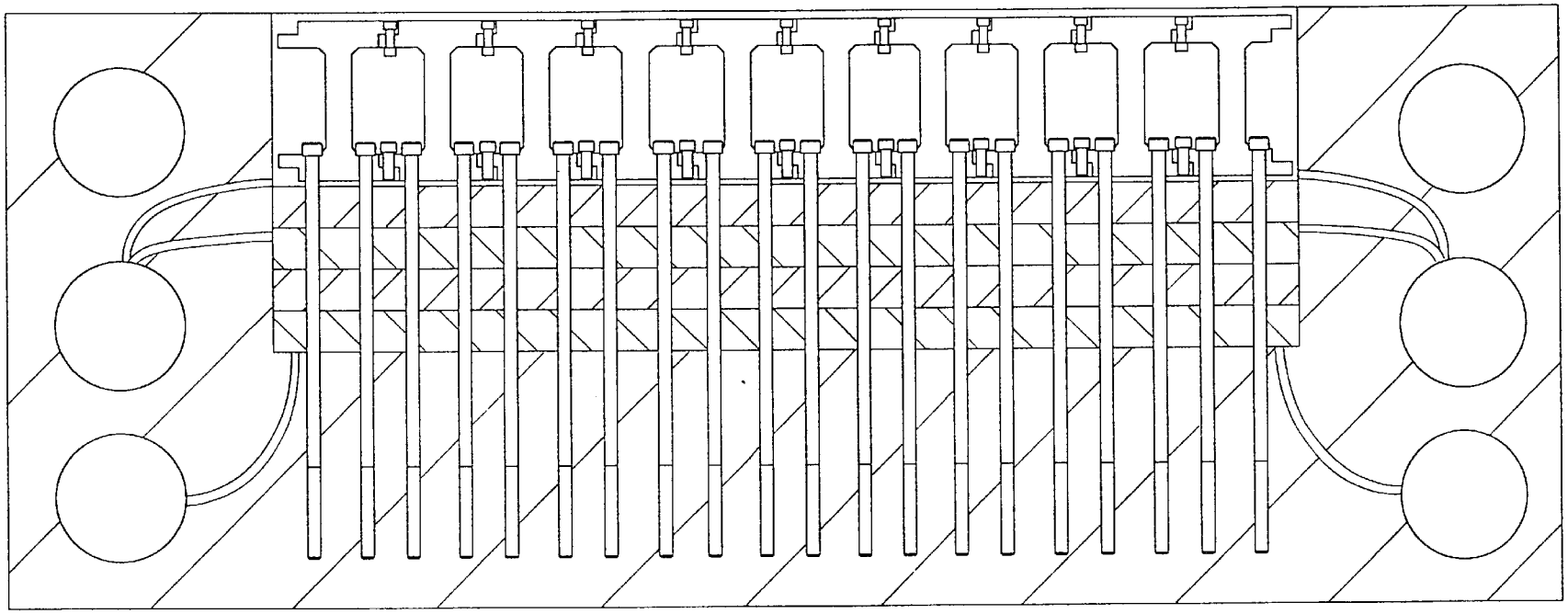
Figure 13C:
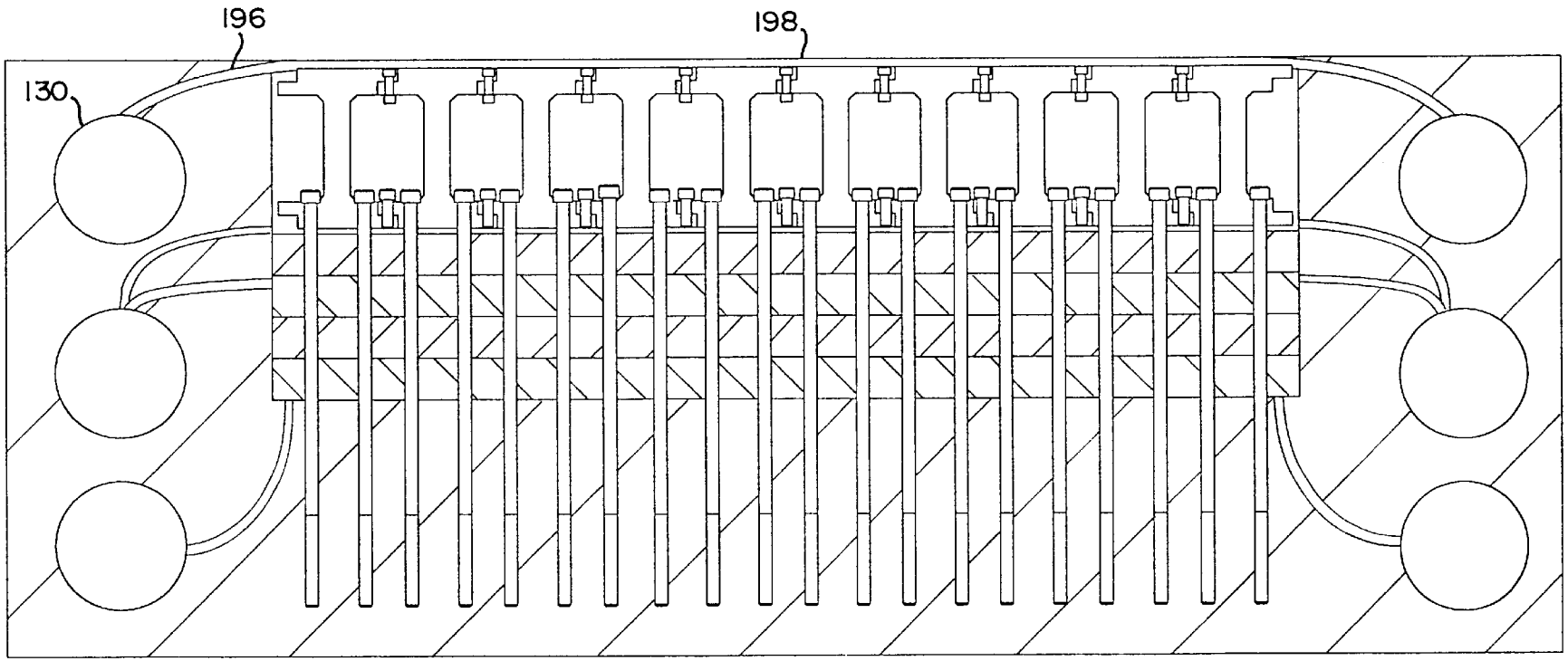

In another embodiment of the invention (FIGS. 13A–13C) anchors 14 of FIG. 3 are secured together using bolts 42, either on a concrete base 110 or upon a base of compacted aggregate. Pylons 114 (FIG. 13B) are driven through holes 46 in the base of the anchor 14 to secure the anchor 14. A top drain 196 is connected to the storm sewer 130. A layer of elastomer 198 is placed over the anchors 14 and the system 10 is completed as discussed above.

Figure 14A:
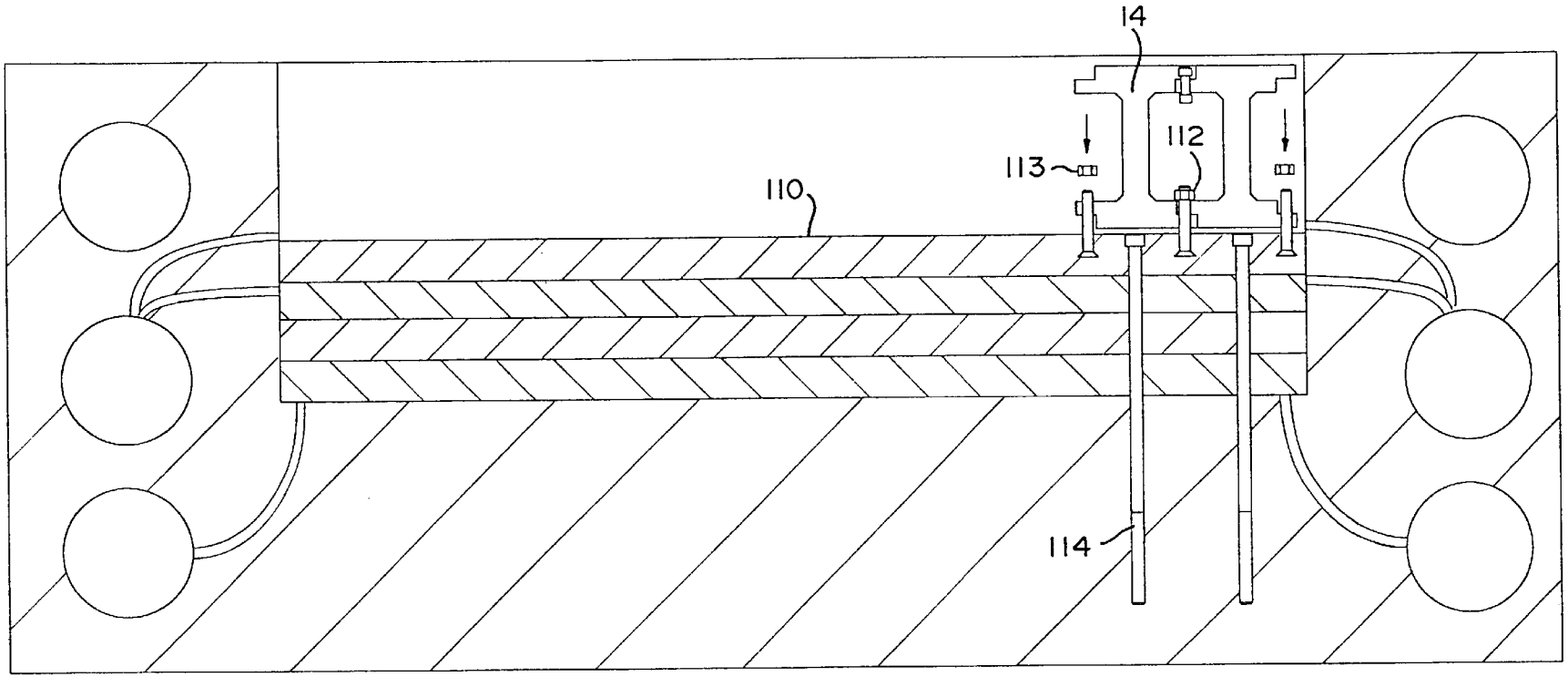
FIGS. 14A–14C depict construction details of another embodiment of the highway of FIG. 1.
Figure 14B:
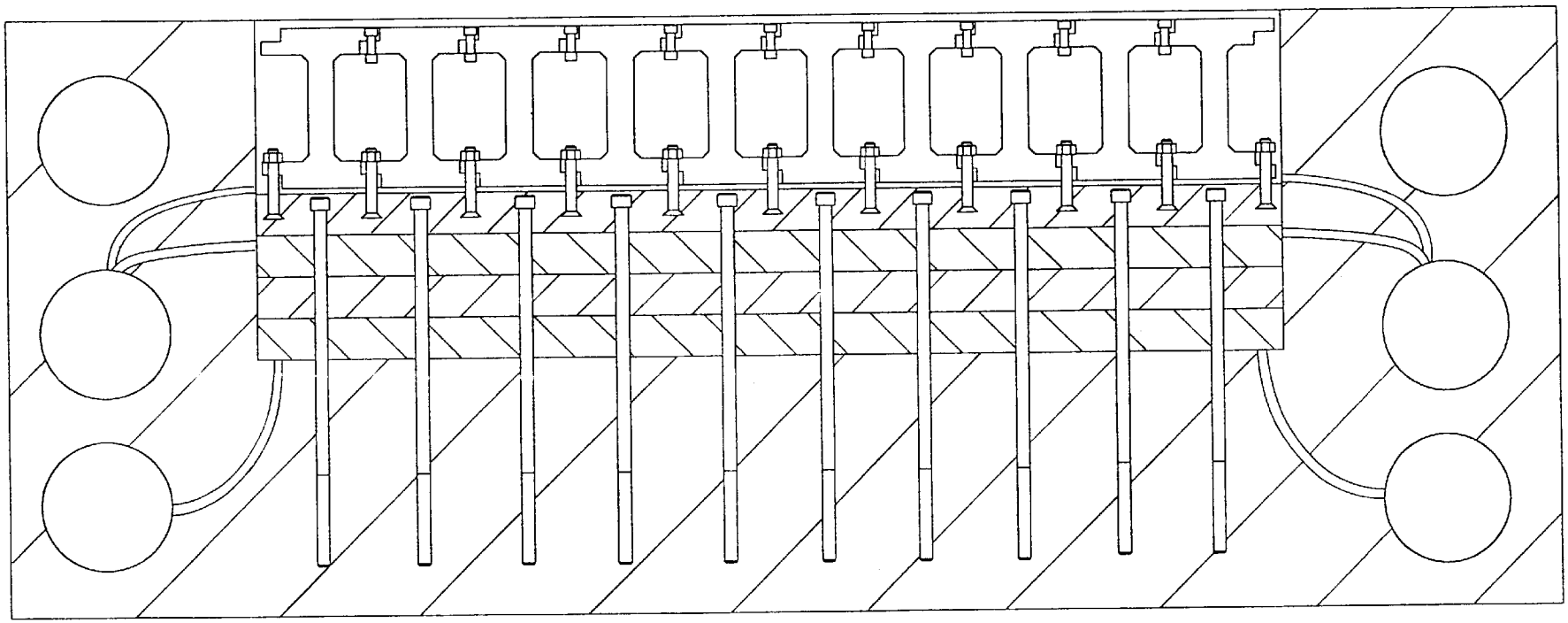
Figure 14C:
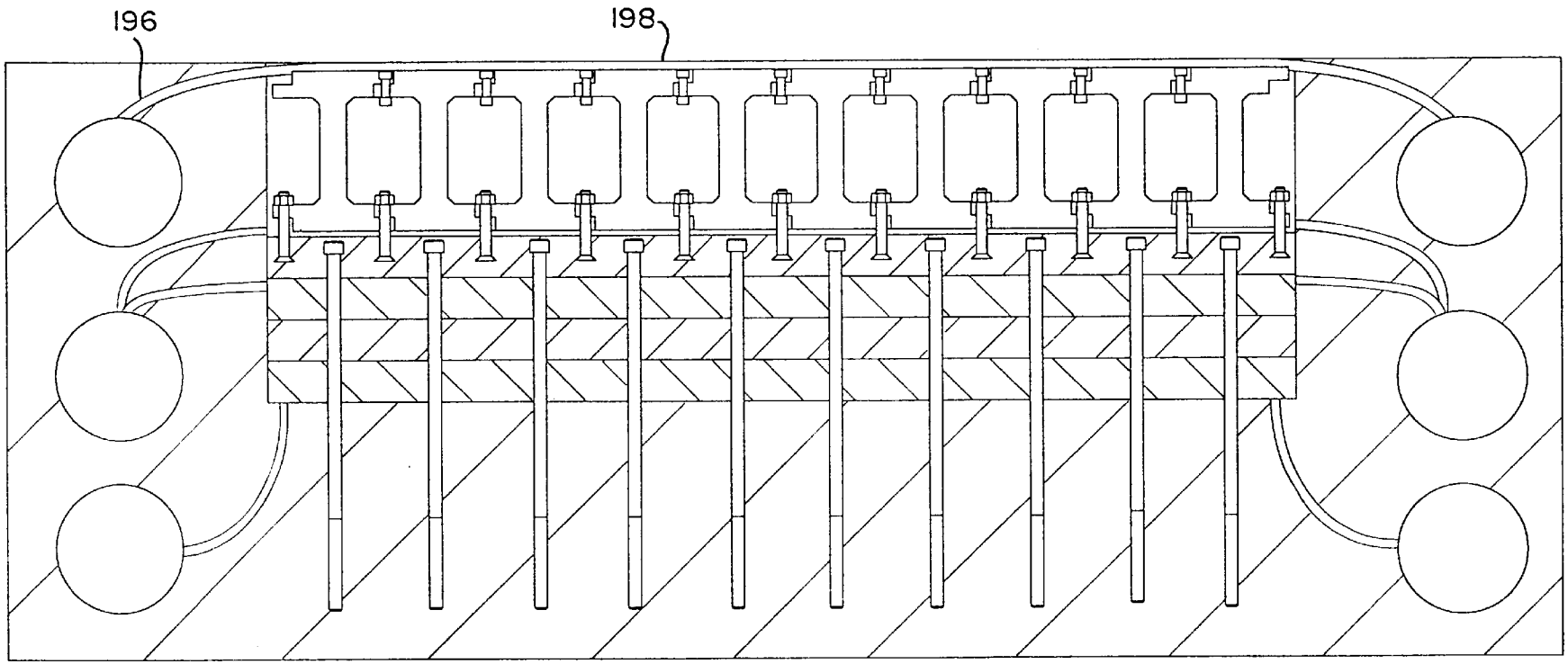

In another embodiment of the invention (FIG. 14A–14C), the bolts 112 used to secure anchors 14 together are embedded in the concrete base 110. The concrete bases 110 are installed in the trench 126 and secured in place by pylons 114 driven into the supporting earth. The anchors 14 are placed over the bolts 112 and secured with nuts 113 (FIG. 14B). The lane sections 16 may then be placed over the anchors 14 and the system 10 completed as described above.

Figure 15A:
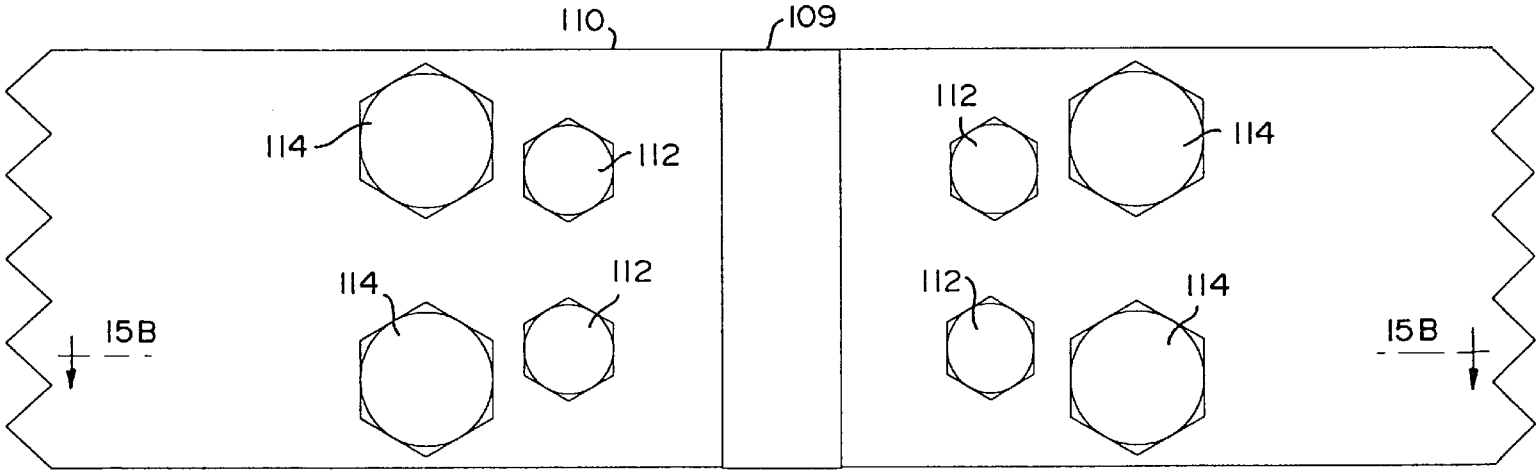
FIGS. 15A–B depict the construction of a concrete base used in the support of the anchors of FIG. 1.
Figure 15B:
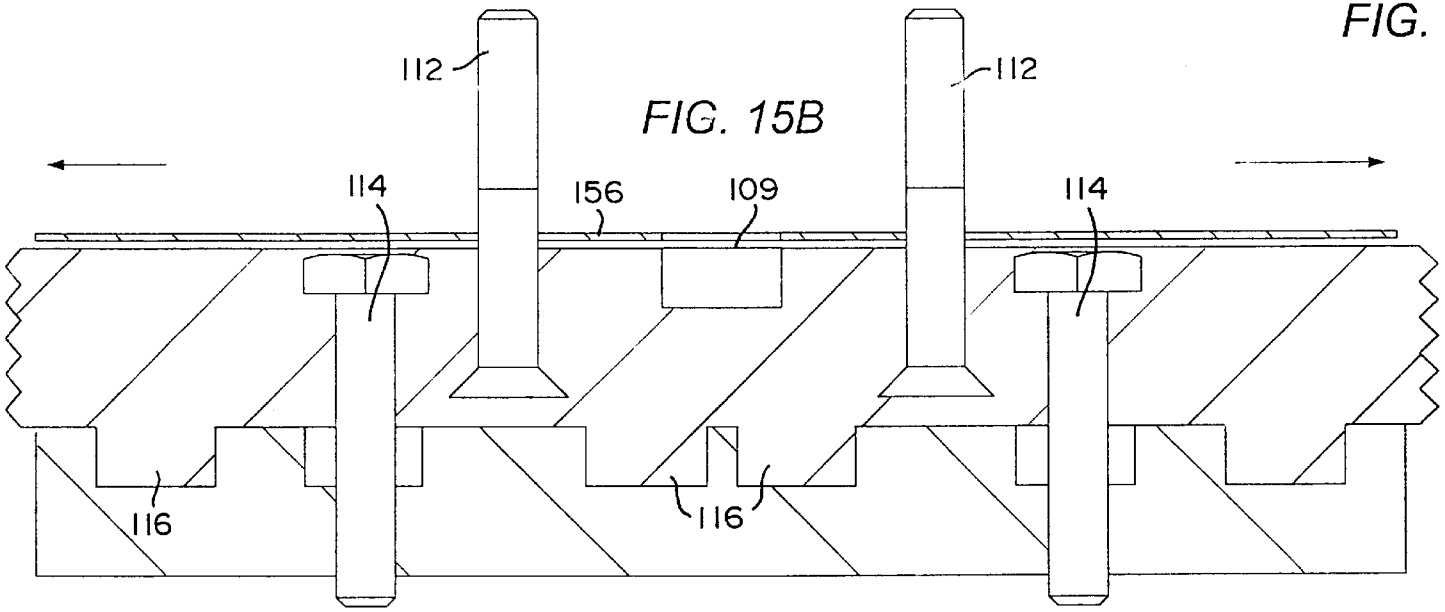

FIGS. 15A–15B show detailed views of the base 110 used in an embodiment of the invention. A top view of the base 110, with the pylons 114, and the anchor bolts 112 embedded in the base 110, and the slot 109 in the base to accept the rib 108 in the anchor base 106. In addition, a side view of the base 110 shows the ribs 116 in the bottom of the base 110, which provide additional stability, and the vibration isolation layer 156 of elastomeric material.

Figures 16A, 16B:
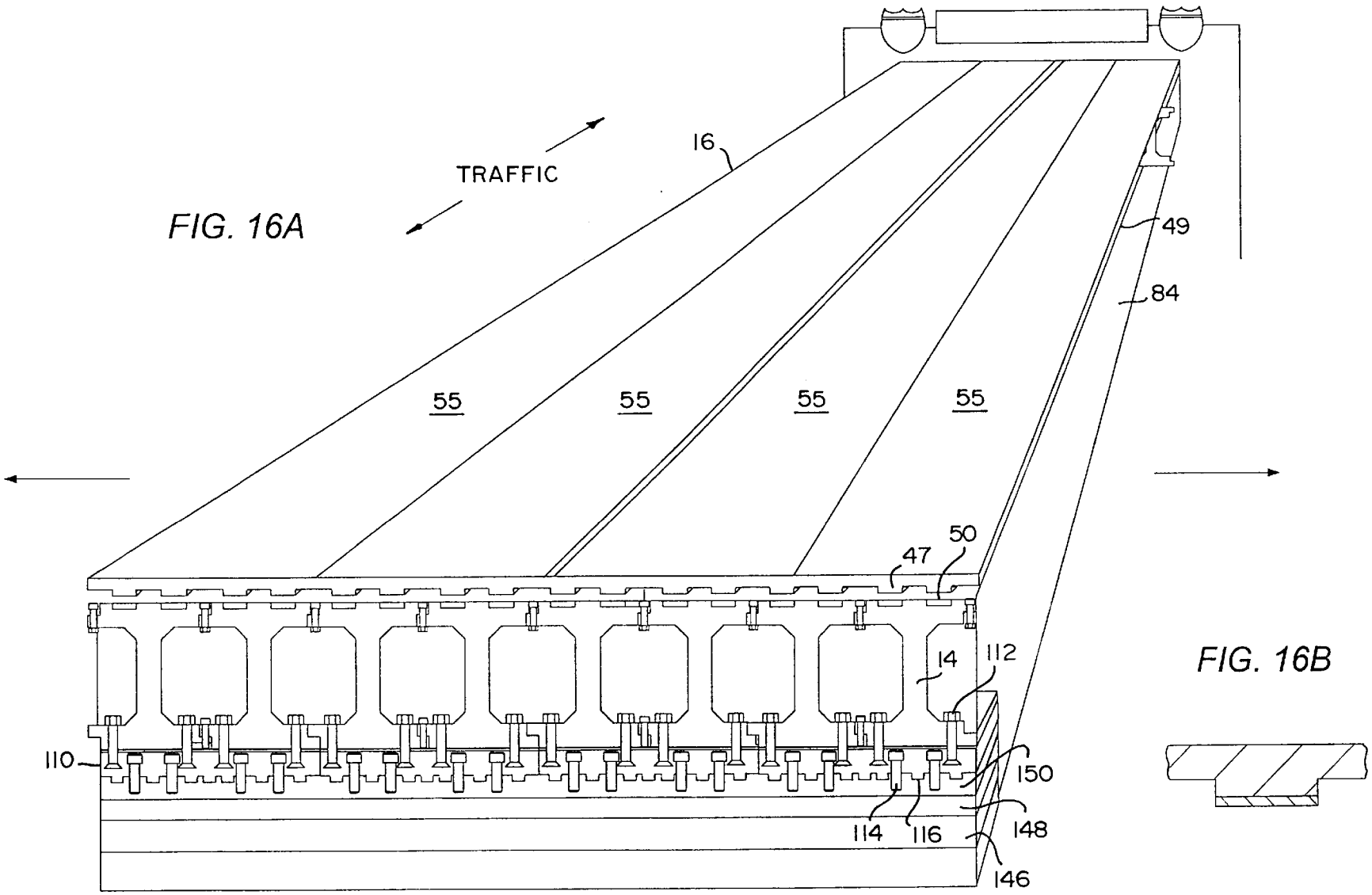
FIG. 16 is another perspective view of a section of the prefabricated highway of FIG. 1 consisting of several lanes supported by anchors on concrete bases.

FIG. 16 shows a detailed view of the invention, without the side structures and storm drains. It shows multiple lanes 16, with surfaces 55, the ribs 47 under the lane sections 16, and the corresponding slots 48 of the anchors 14 receiving the ribs 47. The view shows the anchor bolts 112 embedded in the base 110, the pylons 114 anchoring the base in the trench with layers of compacted aggregate coarse, medium, and fine layers 146, 148, 150. The chemical insulation barrier 49 between the lightly compacted fill 84 and the lane section 16 is also shown. A simple cross section of the lane 16 and its rib 47 is shown. However, the sensors and surfaces of the section 16, and materials (shown in FIG. 2) are not repeated here.

A specific embodiment of novel methods and apparatus for construction of a prefabricated highway according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. An end support for a prefabricated highway section of the prefabricated highway system comprising:

a first elongated support member for transverse engagement with a longitudinal end of the prefabricated highway section;

a second elongated support member parallel to the first support member and laterally aligned with the first member along an orthogonal axis for abutting an earth support of the prefabricated highway;

a connecting member joining the first and second elongated members in a rigid spaced-apart relationship;

an aperture passing through a set of notches and complementary notches of the first and second support member transverse to a longitudinal axis of the first and second support members for securing the support structure to a support structure of a laterally adjacent prefabricated highway section.

2. An end support for a prefabricated highway section of a prefabricated highway system comprising:

a first elongated support member for transverse engagement with a longitudinal end of the prefabricated highway section;

a second elongated support member parallel to the first support member and laterally aligned with the first member along an orthogonal axis for abutting an earth support of the prefabricated highway; and a connecting member joining the first and second elongated members in a rigid spaced-apart relationship;

a longitudinally transverse aperture passing through the second support member between a notch and complementary notch for accepting an anchor pylon driven into an underlying supporting earth.

3. A prefabricated highway comprising:

a prefabricated highway section having a longitudinal axis along an intended direction of traffic flow and a rib parallel to the traffic flow along a lower surface;

a support structure having an elongated upper support element and a lower support element and a connecting element rigidly joining the upper support element to the lower support element, the upper support element transversely engaging the lower surface of the prefabricated highway section across a longitudinal end of the prefabricated highway section; and a slot disposed across the elongated upper support element engaging the rib on the lower surface of the prefabricated highway section.

4. The prefabricated highway as in claim 3 wherein the lower support element further comprises an elongated element parallel to the upper support element in vertical alignment with the upper support element.

5. The prefabricated highway as in claim 4 wherein the upper and lower support elements have stepped ends for engaging support structures of laterally adjacent prefabricated highway sections.

6. The prefabricated highway as in claim 5 further comprising vertical apertures formed in the stepped ends.

7. The prefabricated highway as in claim 6 further comprising a bolt passing through the vertical aperture of a stepped end of the stepped ends of the upper and lower support elements of the support structure and rigidly joining the support structure to a support structure of a laterally adjacent prefabricated highway section.

8. The prefabricated highway as in claim 3 wherein the lower support element further comprises an earth support for the prefabricated highway.

9. The prefabricated highway as in claim 3 wherein the longitudinal rib of the prefabricated highway section further comprises an electrical conduit extending between access holes proximate opposing longitudinal ends of the prefabricated highway section.

10. The prefabricated highway as in claim 3 wherein the prefabricated highway section further comprises lane markers disposed on an upper surface of a roadbed of each prefabricated highway section.

11. The prefabricated highway as in claim 3 wherein the prefabricated highway section further comprises a roadbed having a substrate of a contrasting color for providing visual indication of roadbed wear.

12. The prefabricated highway as in claim 3 wherein the prefabricated highway section further comprises a roadbed having a substrate of a wear-resistant corrugate for providing audio indication of roadbed wear.

13. The prefabricated highway as in claim 3 wherein the prefabricated highway section further comprises wear sensors disposed in a roadbed of the prefabricated highway section.

14. The prefabricated highway as in claim 3 wherein the prefabricated highway section further comprises vibration sensors disposed in a roadbed of the prefabricated highway section.

15. The prefabricated highway as in claim 3 wherein the prefabricated highway section further comprises stress gauges disposed in a roadbed of the prefabricated highway section.

16. The prefabricated highway as in claim 3 wherein the support structure further comprises vibration sensors for measuring vibration of the support structure.

17. The prefabricated highway as in claim 3 wherein the support structure further comprises stress gauges for measuring stress within the support structure.

18. The prefabricated highway as in claim 3 further comprising a highway sidewall.

19. The prefabricated highway as in claim 18 wherein the highway sidewall further comprises integral storm drains.

20. A support structure for a prefabricated highway section comprising:

a first elongated support member for transverse engagement of a longitudinal end of the prefabricated highway section;

a second elongated support member parallel to the first support member and aligned with the first member along an orthogonal axis for abutting an earth support of the prefabricated highway;

a connecting member joining the first and second elongated members in a rigid spaced-apart relationship; and a notch disposed on a first end of the first and second support members and a complementary notch disposed in an opposing end of the first and second support members for engaging a support structure of a laterally adjacent prefabricated highway section.

21. The support structure as in claim 20 further comprising an aperture passing through the notches and complementary notches of the first and second support member transverse to a longitudinal axis of the first and second support members for securing the support structure to a support structure of the laterally adjacent prefabricated highway section.

22. The support structure as in claim 20 further comprising a longitudinally transverse aperture passing through the second support member between the notch and complementary notch for accepting an anchor pylon driven into an underlying supporting earth.

* * * * *